US008814309B2

(12) United States Patent
Koshikawa et al.

(10) Patent No.: US 8,814,309 B2
(45) Date of Patent: Aug. 26, 2014

(54) INK JET RECORDING APPARATUS

(75) Inventors: Masahiro Koshikawa, Kawasaki (JP); Yuki Igarashi, Tokyo (JP); Takayuki Nishinohara, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 330 days.

(21) Appl. No.: 13/031,132

(22) Filed: Feb. 18, 2011

(65) Prior Publication Data

US 2011/0205280 A1 Aug. 25, 2011

(30) Foreign Application Priority Data

Feb. 24, 2010 (JP) ..... 2010-039424

(51) Int. Cl.

| | |
|---|---|
| ***B41J 29/38*** | (2006.01) |
| ***B41J 11/42*** | (2006.01) |
| ***B41J 29/393*** | (2006.01) |
| *B41J 3/60* | (2006.01) |
| *B41J 11/00* | (2006.01) |

(52) U.S. Cl.

CPC ..... *B41J 11/42* (2013.01); *B41J 29/393* (2013.01); *B41J 29/38* (2013.01); *B41J 3/60* (2013.01); *B41J 11/0095* (2013.01)

USPC ..... 347/16; 347/104

(58) Field of Classification Search

CPC ..... B41J 11/42; B41J 29/393; B41J 29/38; B41J 3/60; B41J 11/0095

USPC ..... 347/16, 104; 399/15

See application file for complete search history.

(56) References Cited

U.S. PATENT DOCUMENTS

| | | | | |
|---|---|---|---|---|
| 2004/0252176 | A1* | 12/2004 | Sugiura | 347/104 |
| 2005/0152706 | A1* | 7/2005 | Koie et al. | 399/15 |
| 2008/0049089 | A1* | 2/2008 | Ishikawa et al. | 347/104 |
| 2008/0198195 | A1 | 8/2008 | Matsumura | |
| 2010/0044947 | A1* | 2/2010 | Teshigawara et al. | 271/3.15 |

FOREIGN PATENT DOCUMENTS

| | | | |
|---|---|---|---|
| JP | 06-143705 | A | 5/1994 |
| JP | 2008-200893 | A | 9/2008 |

* cited by examiner

*Primary Examiner* — Manish S Shah
*Assistant Examiner* — Yaovi Ameh
(74) *Attorney, Agent, or Firm* — Canon USA, Inc., IP Division

(57) ABSTRACT

An ink jet recording apparatus is equipped with an upstream side conveyance unit arranged on a conveyance upstream side of a recording head and a downstream side conveyance unit arranged on a conveyance downstream side thereof. The ink jet recording apparatus obtains, by recording a test pattern on a sheet, a conveyance correction amount when conveyance is performed solely by the downstream side conveyance unit. The ink jet recording apparatus includes a control unit which, when effecting an arbitrary recording, effects control such that, when a sheet trailing edge leaves the upstream side conveyance unit, a rotating position of a drive side roller of the downstream side conveyance unit is the same as the rotating position of the drive side roller when the test pattern is recorded.

8 Claims, 19 Drawing Sheets

8-PATH NORMAL RECORDING

RECORDING MEDIUM TRAILING EDGE

FIRST SCANNING

SECOND SCANNING

FIRST SCANNING + SECOND SCANNING

FIG.13

| SHEET SIZE | SHEET LENGTH IN CONVEYANCE DIRECTION [mm] | DIFFERENCE FROM TEST PATTERN [mm] | OFFSET ANGLE [deg] |
|---|---|---|---|
| LETTER | 279.4 | 0 | 0 |
| A4 | 297 | 17.6 | 158.4 |
| LEGAL | 355.6 | 76.2 | 325.8 |

· TEST PATTERN IS RECORDED IN LETTER SIZE
· PERIPHERAL LENGTH OF CONVEYANCE ROLLER IS 40mm

FIG.17

| STEP | TRAILING EDGE POSITION OF SHEET | CONVEYANCE STATE | DISCHARGE ROLLER 12 | SPUR 13 |
|---|---|---|---|---|
| S31 | UPSTREAM SIDE OF SHEET DETERMINATION SENSOR 41 | FIRST | ROTATED IN THE SAME DIRECTION AS CONVEYANCE ROLLER 1 | RAISED FIG.20B |
| S32 | REACHED SHEET DETERMINATION SENSOR 41 | FIRST | MOVED TO AND STOPPED AT HOME POSITION | RAISED FIG.20B |
| S33 | UPSTREAM SIDE OF CONVEYANCE ROLLER 1 BY 10mm | FIRST | ROTATED IN THE SAME DIRECTION AS CONVEYANCE ROLLER 1 | LOWERED FIG.20A |
| S34 | PASSED CONVEYANCE ROLLER 1 | FIRST TO SECOND | ROTATED IN THE SAME DIRECTION AS CONVEYANCE ROLLER 1 | LOWERED FIG.20A |

FIG.18A

| | A5 148.5mm | B5 182.0mm | EXECUTIVE 184.2mm | A4 210mm | LETTER/ LEGAL 215.9mm | B4 257.0mm | LEISURE 279.4mm | A3 297.0mm |
|---|---|---|---|---|---|---|---|---|
| CORRECTION VALUE OF REGION B | | | | -8 | | -5 | | |
| CORRECTION VALUE OF REGION C | | | | -40 | | -25 | | |

FIG.18B

| | ~100mm | 101mm ~150mm | 151mm ~200mm | 201mm ~250mm | 251mm ~300mm | 301mm~ |
|---|---|---|---|---|---|---|
| CORRECTION VALUE OF REGION B | | | | -8 | -5 | |
| CORRECTION VALUE OF REGION C | | | | -40 | -25 | |

FIG.19

| | | SHEET SIZE WHOSE OFFSET AMOUNT IS TO BE OBTAINED [9600dpi] | | | | | | | | | | | | | |
|---|---|---|---|---|---|---|---|---|---|---|---|---|---|---|---|
| | | A5 148.5mm | | B5 182.0mm | | EXECUTIVE 184.2mm | | A4 210mm | | LETTER/ LEGAL 215.9mm | | B4 257.0mm | | LEISURE 279.4mm | |
| | | B | C | B | C | B | C | B | C | B | C | B | C | B | C |
| SHEET SIZE WHOSE CORRECTION VALUE HAS BEEN CALCULATED | A5 | | | +4 | +15 | +4 | +15 | +6 | +20 | +6 | +20 | +8 | +25 | +10 | +30 |
| | B5 | -4 | -15 | | | 0 | 0 | +2 | +10 | +2 | +10 | +4 | +15 | +6 | +20 |
| | EXECUTIVE | -4 | -15 | 0 | 0 | | | +2 | +10 | +2 | +10 | +4 | +15 | +6 | +20 |
| | A4 | -6 | -20 | -2 | -10 | -2 | -10 | | | 0 | 0 | +2 | +10 | +4 | +15 |
| | LETTER/LEGAL | -6 | -20 | -2 | -10 | -2 | -10 | 0 | 0 | | | +2 | +10 | +4 | +15 |
| | B4 | -8 | -25 | -4 | -15 | -4 | -15 | -2 | -10 | -2 | -10 | | | +2 | +10 |
| | LEISURE | -10 | -30 | -6 | -20 | -6 | -20 | -4 | -15 | -4 | -15 | -2 | -10 | | |

INK JET RECORDING APPARATUS

BACKGROUND OF THE INVENTION

1. Field of the Invention

The present invention relates to an ink jet recording apparatus equipped with a sheet conveyance mechanism having an upstream side conveyance unit arranged on the conveyance upstream side of a recording head and a downstream side conveyance unit arranged on the conveyance downstream side thereof.

2. Description of the Related Art

As a form of a recording apparatus such as a printer, a copying machine, or a facsimile apparatus, an ink jet recording apparatus is used which performs recording by discharging ink onto a sheet from a discharge port of a recording head based on image information. Further, in a recording apparatus, there is widely employed a construction equipped with a sheet conveyance mechanism having an upstream side conveyance unit arranged on the conveyance upstream side of a recording head and a downstream side conveyance unit arranged on the conveyance downstream side thereof. Here, a state in which a sheet is pinched (or nipped) between both the upstream side conveyance unit and the downstream side conveyance unit is referred to as a first conveyance state, and a state in which the sheet is pinched solely by the downstream side conveyance unit is referred to as a second conveyance state. When the recording proceeds from the first conveyance state to reach a state in which recording can be performed on a sheet trailing edge portion, the sheet trailing edge portion leaves the position where it has been pinched by the upstream side conveyance unit. At this time, the sheet is switched to the second conveyance state, in which it is held solely by the downstream side conveyance unit. Then, since the downstream side conveyance unit is configured to convey the sheet at a higher speed than the upstream side conveyance unit, the sheet is conveyed at a higher speed than in the first conveyance state. Thus, when the conveyance state is switched, excessive conveyance occurs, which may lead to deterioration in sheet image quality such as white streak or color misregistration.

In this connection, Japanese Patent Application Laid-Open No. 2008-200893, for example, discusses a control method in which correction is effected with respect to the second conveyance state. Japanese Patent Application Laid-Open No. 2008-200893 discusses a control method according to which a test pattern is recorded when conveyance in both the first and second conveyance states has been completed (in other words, when the sheet trailing edge has left the upstream side conveyance unit), and when conveyance is performed solely in the second conveyance state. In this control method, according to the test pattern recording result, a correction amount, in which, for example, individual differences in the recording apparatus and the sheet are taken into account, is calculated, thus effecting the correction of the conveyance amount.

However, in the above related art, when the offset amount of the rollers of the upstream side conveyance unit and of the downstream side conveyance unit is large, the effect of the correction is reduced, making the recording result rather unstable in some cases. In particular, regarding a discharge roller as a drive side roller used for the downstream side conveyance unit, the offset amount is larger as compared with that of a conveyance roller as a drive side roller used for the upstream side conveyance unit. More specifically, the discharge roller is generally configured such that a plurality of rubber rollers is engaged with a metal shaft, so that it involves a rather large offset amount. Further, elastic deformation (tremor) of the metal shaft also causes an increase in the offset amount. Further, as the metal shaft of the discharge roller, generally the shaft having lower rigidity as compared with the conveyance roller is used. Generally speaking, a roller pair of the upstream side conveyance unit is formed by the conveyance roller and a pinch roller which is a driven rotary member, and a roller pair of the downstream side conveyance unit is formed by the discharge roller and a spur which is a driven rotary member.

The discharge roller is configured to perform conveyance at a higher speed as compared with the conveyance roller. Thus, in the first conveyance state, in which conveyance is performed by both the conveyance roller and the discharge roller, the discharge roller having lower rigidity, is attracted to the conveyance roller side. And, when switching to the second conveyance state, the deflection of the discharge roller that has been attracted is released. The behavior at this time varies according to the deformation (tremor) state of the metal shaft. More specifically, when the sheet is conveyed solely by the downstream side conveyance unit, if the rotating position where the discharge roller is in contact with the sheet is different from the rotating position at the time of the test pattern recording for conveyance amount correction, the conveyance correction amount may be inadequate.

SUMMARY OF THE INVENTION

An aspect of the present invention is directed to an ink jet recording apparatus which enables high precision conveyance with a reduced variation in conveyance amount due to offset of a roller of the downstream side conveyance unit, and which helps to prevent deterioration in image quality, making it possible to obtain a satisfactory image in a stable manner.

According to an aspect of the present invention, an ink jet recording apparatus is equipped with an upstream side conveyance unit arranged on a conveyance upstream side of a recording head and a downstream side conveyance unit arranged on a conveyance downstream side thereof. The ink-jet recording apparatus obtains, by recording a test pattern on a sheet, a conveyance correction amount when conveyance is performed solely by the downstream side conveyance unit. The ink jet recording apparatus includes a control unit which, when effecting an arbitrary recording, effects control such that, when a sheet trailing edge leaves the upstream side conveyance unit, a rotating position of a drive side roller of the downstream side conveyance unit is the same as the rotating position of the drive side roller when the test pattern is recorded.

According to an aspect of the present invention, there is provided an ink jet recording apparatus which makes it possible to perform high precision conveyance with reduced variation in conveyance amount due to offset of a roller of the downstream side conveyance unit, preventing deterioration in image quality and making it possible to obtain a satisfactory image in a stable manner.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 13 is a table showing the relationship between sheet size and conveyance roller offset angle.

FIG. 17 is a table illustrating the movement of a discharge roller and a spur of the inkjet recording apparatus of the third exemplary embodiment.

FIGS. 18A and 18B show examples of a table storing a conveyance correction amount for each sheet size in an ink jet recording apparatus according to a fourth exemplary embodiment.

FIG. 19 shows an example of a table storing conveyance correction amount offset amounts for an ink jet recording apparatus according to a fifth exemplary embodiment.

DESCRIPTION OF THE EMBODIMENTS

Figure 1:
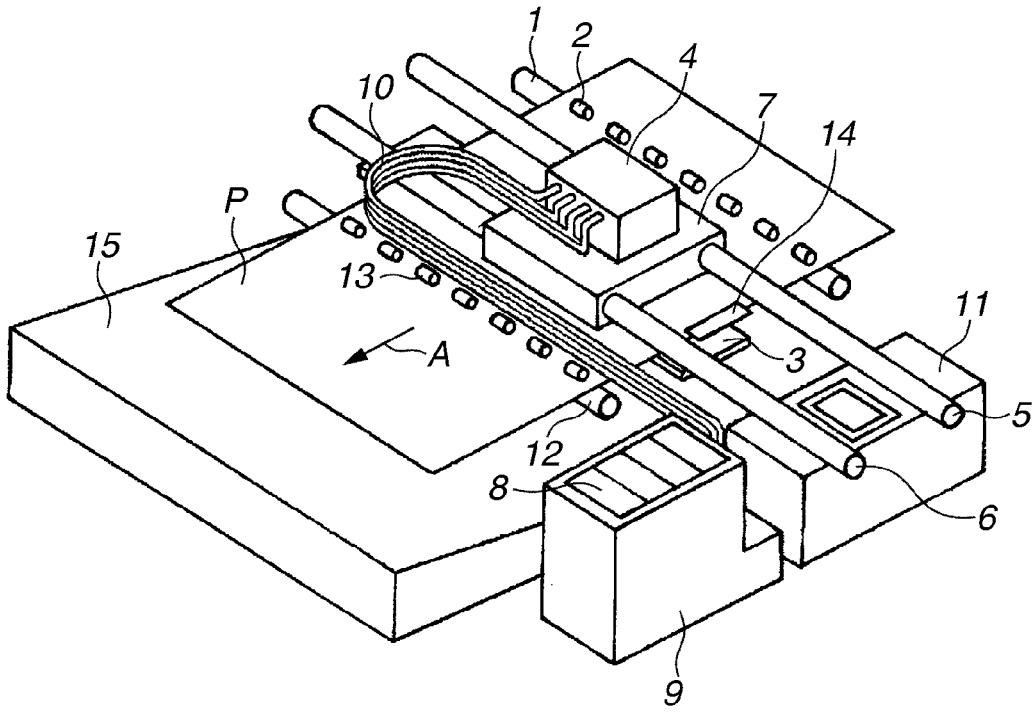
FIG. 1 is a perspective view of an ink jet recording apparatus according to a first exemplary embodiment.

Various exemplary embodiments, features, and aspects of the invention will be described in detail below with reference to the drawings. In the diagrams, the same reference numerals are used for the same or equivalent components.

FIG. 1 is a perspective view of an ink jet recording apparatus according to the first exemplary embodiment. When performing recording, a sheet P (i.e., a recording medium) is pinched between a conveyance roller 1 arranged in a conveyance route and pinch rollers 2 driven thereby, and is conveyed in the direction of the arrow A in the drawing while guided and supported by a platen 3 along with rotation of the conveyance roller 1, which is a drive side roller. The conveyance roller 1 is a metal roller having on its surface minute protrusions and recesses and capable of exerting a large frictional force. The pinch rollers 2 are elastically urged against the conveyance roller 1 by a pressure unit such as a spring (not shown). The conveyance roller 1 and the pinch rollers 2 constitute an upstream side conveyance unit arranged on the upstream side of a recording head 4.

The recording head 4 is an ink jet recording head discharging ink onto the sheet P from a discharge port to perform recording and the platen 3 is arranged at a position opposed to the recording head 4. The platen 3 supports the back surface of the sheet P, thereby maintaining a predetermined distance between the recording surface of the sheet P and the discharge surface of the recording head. The sheet P, which undergoes recording while it is conveyed on the platen 3, is conveyed in the direction of the arrow A while pinched by a discharge roller 12 and spurs 13 which are rotary members driven thereby, and is discharged onto a discharge tray 15 from the platen 3. The discharge roller 12 and the spurs 13 arranged on the downstream side of the recording head 4 constitute a downstream side conveyance unit. The discharge roller 12 is a rubber roller having a large friction coefficient. The spurs 13 are elastically pressed (urged) against the discharge roller 12 by a pressurization unit such as a spring (not shown).

The pressing force of the spurs 13 with respect to the discharge roller 12 is set to approximately 1/10 of the pressing force of the pinch rollers 2 acting on the discharge roller 1. As a result, it is possible to prevent the surface of the sheet P from being flawed or dented after image recording. Further, to prevent sagging of the sheet P on which recording is performed, the roller diameter, etc. of the conveyance roller 1 are set such that its peripheral speed is increased by approximately 1% as compared with the discharge roller 12. As a result, in a first conveyance state, in which the sheet P is pinched/conveyed by both the conveyance roller 1 side and the discharge roller 12 side, due to the difference in their pinching force, the sheet is conveyed slipping in the discharge roller 12. In order to suppress an end portion of the sheet P in a direction crossing the conveyance direction A, from rising upwardly, in other words, rising in the direction of the discharge surface of the recording head 4, the platen 3 is provided with a sheet holder 14.

The recording head 4 is detachably mounted on a carriage 7 with its discharge surface (the front surface where discharge ports are arranged) opposed to the platen 3 or the sheet P. The carriage 7 can be reciprocated along two guide rails 5 and 6 by a drive unit such as a motor (not shown), and, in synchronization with the movement, it is possible to discharge ink onto the sheet P from the recording head 4. The carriage moving direction is a direction crossing the sheet conveyance direction (the direction of the arrow A); it is referred to as a main scanning direction. In this connection, the sheet conveyance direction is referred to as a sub scanning direction. And, by alternately repeating the main scanning with the carriage 7 or the recording head 4, and the conveyance of the sheet (sub scanning), recording is performed on the sheet P.

As the recording head 4, it is possible to employ a type which uses a heat generation resistor element as an energy generation element for, for example, discharging ink, and which causes a change in the ink condition due to the heat energy (film boiling). By using this type of recording head, it is possible to attain high density and high definition in recording. Of course, it is also possible to employ a recording head of other types, for example, one using vibration energy. On the discharge surface of the recording head, there is provided a nozzle row in which there are arranged 1280 nozzles (discharge ports) at an interval, for example, of 1200 dpi (dot/inch). In color recording or the like, a plurality of nozzle rows are provided according to the ink colors, or a plurality of recording heads each having a nozzle row of a different color is used. In correspondence with the colors of inks discharged from the recording head 4, a plurality of independent ink tanks 8 is detachably attached to a tank attachment unit 9. The tank attachment unit 9 and the recording head 4 are connected to each other by a plurality of liquid supply tubes 10 respectively corresponding to the ink colors. By attaching the ink tanks 8 of the different colors to the tank attachment unit 9, it is possible to independently supply the inks of the different colors to the corresponding nozzle rows of the recording head 4.

In a region which is within the movable range in the main scanning direction of the recording head 4 and which is off the recording range, a recovery unit 11 is arranged, which is capable of facing the discharge surface of the recording head 4. The recovery unit 11 is composed of a cap portion for performing capping on the discharge surface of the recording head 4, a suction mechanism forcibly sucking ink from the recording head 4 with the discharge surface capped, a cleaning blade for wiping away soil on the ink discharge surface, etc.

Figure 2:
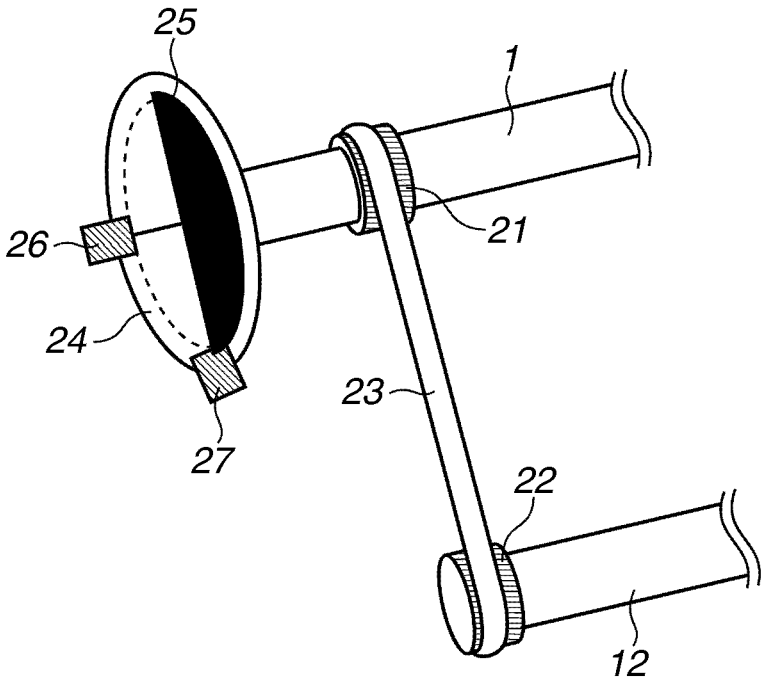
FIG. 2 is a perspective view of a drive transmission portion of a conveyance system of the ink jet recording apparatus according to the first exemplary embodiment.

FIG. 2 is a perspective view of a drive transmission portion of a conveyance mechanism of the ink jet recording apparatus of the first exemplary embodiment. The conveyance roller 1, which is the driving roller on the upstream side conveyance unit, receives a drive from a conveyance motor (not illustrated) to rotate. A conveyance pulley 21 is fixed coaxially with the conveyance roller 1, and a discharge pulley 22 is fixed coaxially with the discharge roller 12. Between the conveyance pulley 21 and the discharge pulley 22, a conveyance belt 23 for transmitting the drive of the conveyance roller to the discharge roller is stretched. More specifically, in the present exemplary embodiment, the conveyance roller 1 and the discharge roller 12 are driven synchronously by a common motor. Information on the rotating position and the rotating speed of the conveyance roller 1 is measured by reading a code wheel 24 provided on the conveyance roller 1 by an encoder 26. Provided on the code wheel 24 is a home position mark 25 for controlling the home position of the conveyance roller 1. By confirming (identifying) the home position mark 25 by the home position sensor 27, it is possible to control the rotating position of the conveyance roller 1. In the present exemplary embodiment, the conveyance pulley 21 and the discharge pulley 22 are of the same diameter, and the relationship between the rotating positions of the conveyance roller 1 and the discharge roller 12 is always the same. Thus, the rotating position of the discharge roller 12 can also be controlled at the same time by using the code wheel 24 of the conveyance roller 1. Further, by forming the conveyance pulley 21 and the discharge pulley 22 as the same molding components, it is possible to achieve an improvement in terms of precision in the rotating position control.

Figure 3:
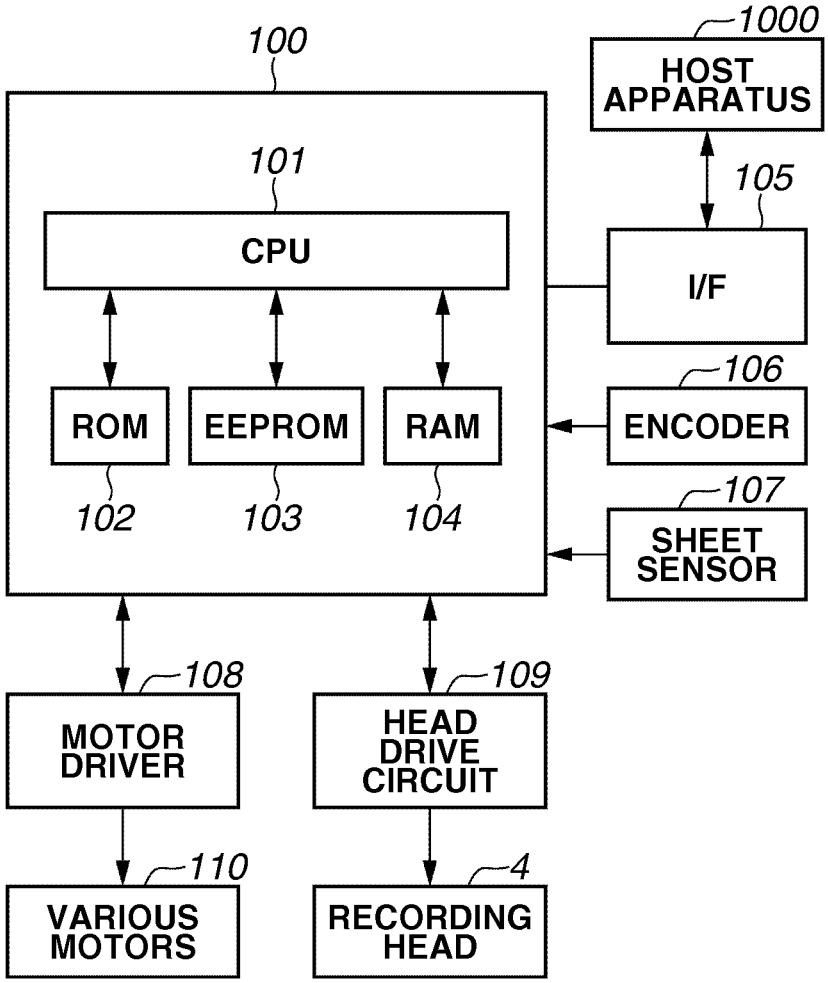
FIG. 3 is a block diagram illustrating a control system of the ink jet recording apparatus.

FIG. 3 is a block diagram illustrating a control system of the ink jet recording apparatus. A control unit 100 controlling each drive portion of the ink jet recording apparatus is equipped with a central processing unit (CPU) 101, read-only memory (ROM) 102, an electrically erasable programmable ROM (EEPROM) 103, and random-access memory (RAM) 104. The CPU 101 performs various computations and determinations for processing related to recording operation, inclusive of processing described below; further, it performs processing regarding printing the data (recording information), a test pattern, etc. The ROM 102 stores a program corresponding to the processing executed by the CPU 101, and other stationary data. The EEPROM 103 is nonvolatile memory; it is used to maintain predetermined information even if the power of the recording apparatus is OFF. In particular, in the present exemplary embodiment, it can also be used to maintain a correction amount and an offset amount (described below) for each predetermined sheet. The RAM 104 temporarily stores printing data supplied from the exterior and recording data developed in conformity with this apparatus construction; further, it functions as a work area for computation processing by the CPU 101.

An interface (I/F) 105 serves to connect the ink jet recording apparatus to an external host apparatus 1000; it performs bidirectional communication between itself and the host apparatus 1000 based on a predetermined protocol. The host apparatus 1000 is of a well-known configuration, such as a computer; it serves as a supply source of printing data for causing the recording apparatus to perform printing, and a printer driver, which is a program for effecting the printing operation, is installed therein. More specifically, from the printer driver, printing setting information such as printing data and printing sheet kind information and a control command for effecting operational control on the recording apparatus are transmitted. An encoder 106 detects the position in the main scanning direction of the recording head 4. A sheet sensor 107 is provided at an appropriate position in the sheet conveyance route. By detecting the leading and trailing edges of the sheet by using the sheet sensor 107, it is possible to know the sheet conveyance (sub scanning) position. Further, connected to the control unit 100 are a motor driver 108 and a head drive circuit 109. Under the control of the control unit 100, the motor driver 108 drives a conveyance motor serving as the sheet conveyance drive source, a main scanning motor serving as the drive source for the movement of the carriage 7, and various other motors. Under the control of the control unit 100, the head drive circuit 109 drives the recording head 4 to perform the ink discharging operation.

Next, the recording operation in the present exemplary embodiment will be illustrated. In the present exemplary embodiment, a recording operation is performed in which the recording of the same area on the sheet is completed through one or a plurality of scanning operations. Further, the recording operation is changed according to the combination of the kind of sheet and the recording quality. In the following, by way of example an 8-path recording operation will be described, in which the recording of the same area on the sheet is completed by an image forming apparatus through eight main scanning operations. In the present exemplary embodiment, the recording surface (image forming surface) of the sheet is divided into three regions, and the conveyance amount and the recording operation are different for each region.

Figure 4:
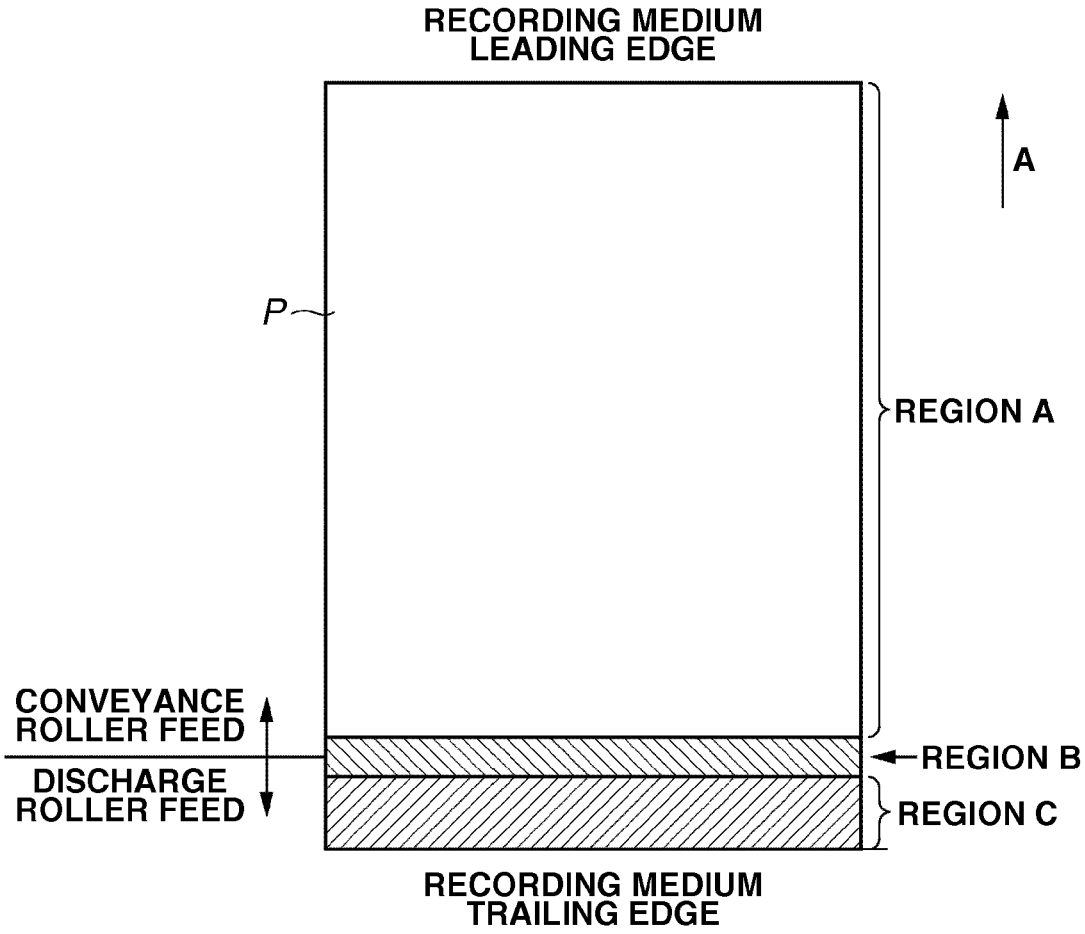
FIG. 4 is an explanatory view illustrating how the recording region of a sheet is divided.
Figure 5A:
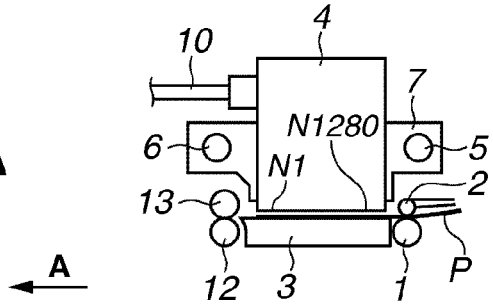
FIGS. 5A, 5B, 5C, 5D, and 5E are side views illustrating the positional relationship between a sheet, a conveyance roller, and a discharge roller in a sheet conveyance process.
Figure 5B:
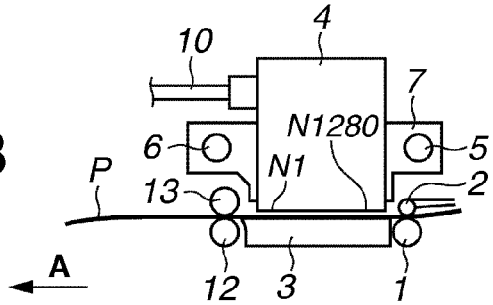
Figure 6:
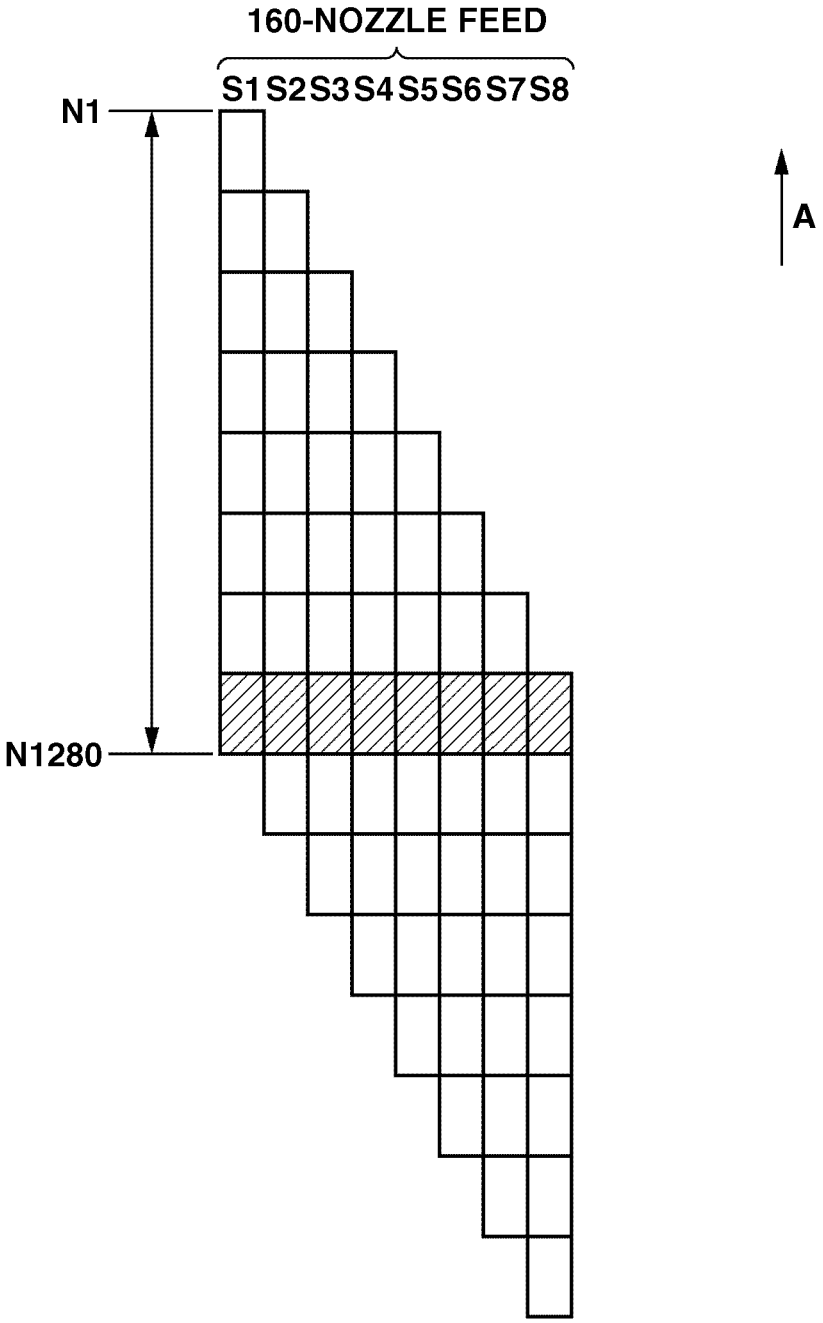
FIG. 6 is an explanatory view illustrating a recording operation and a conveyance operation in a first conveyance state in 8-path recording.
Figure 7:
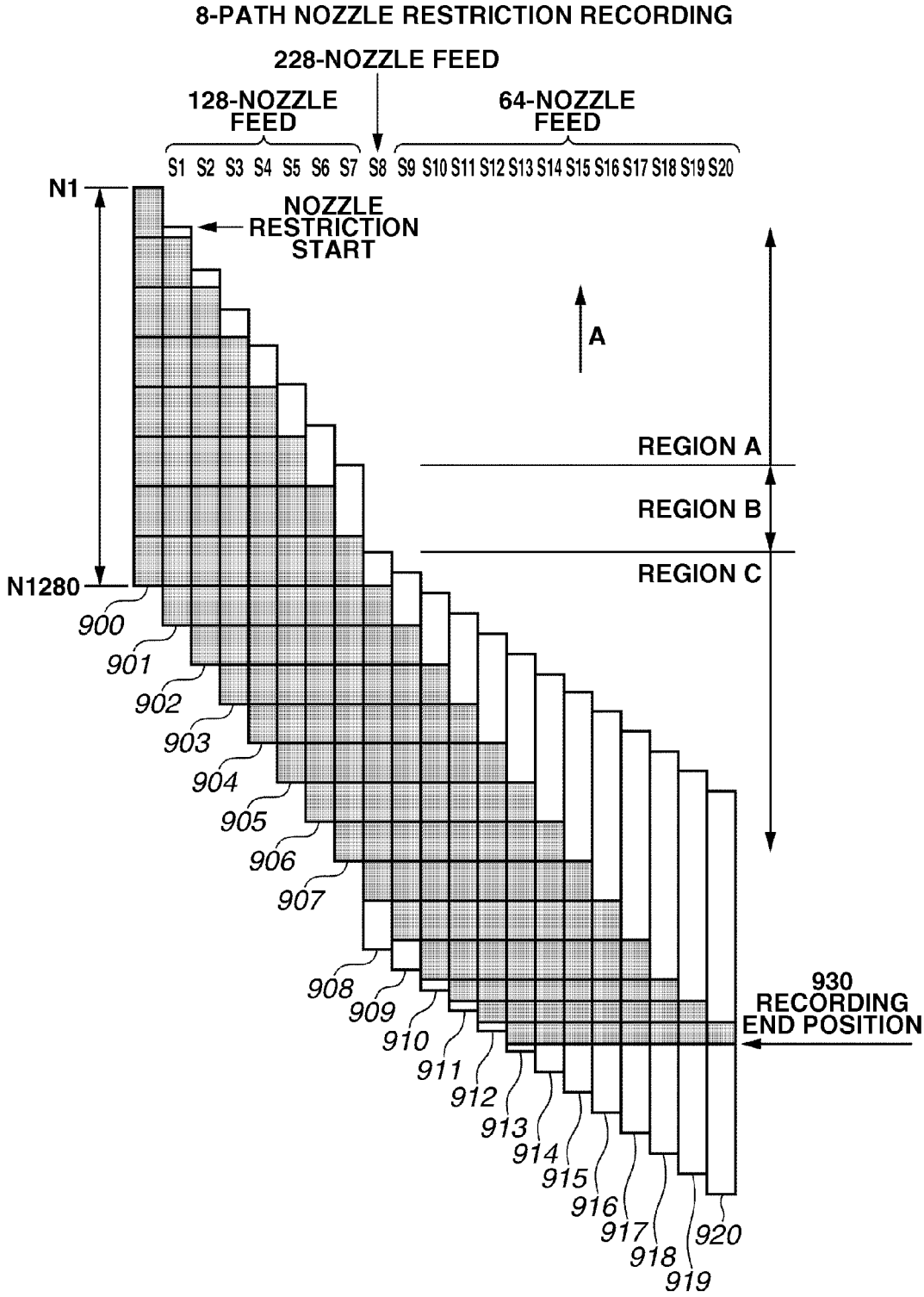
FIG. 7 is an explanatory view illustrating the recording operation and the conveyance operation when switching is effected from the first conveyance state to the second conveyance state in 8-path recording.

FIG. 4 is an explanatory view illustrating an example in which the sheet is divided into three recording regions. FIGS. 5A through 5E are side views illustrating the positional relationship between the sheet, the conveyance roller, and the discharge roller in the sheet conveyance process. FIG. 6 is an explanatory view illustrating the recording operation and the conveyance operation in the first conveyance state in 8-path recording. FIG. 7 is an explanatory view illustrating the recording operation and the conveyance operation when switching is effected from the first conveyance state to the second conveyance state in the 8-path recording. The region A in FIG. 4 is the region in a first conveyance state including a state in which the sheet P is being conveyed solely by the conveyance roller 1 as illustrated in FIG. 5A and a state in which the sheet is being conveyed by the two rollers of the conveyance roller 1 and the discharge roller 12 as illustrated in FIG. 5B. As described above, the pinching force of the roller pair formed by the conveyance roller 1 and the pinch roller 2 is sufficiently larger than the pinching force of the roller pair formed by the discharge roller 12 and the spur 13, so that the conveyance amount is the same in the state of FIG. 5A and the state of FIG. 5B.

Next, the recording operation using the 1280 nozzles (for each color) of the recording head of the exemplary embodiment and the conveyance operation in the region A will be described. In the recording head having a plurality of nozzle rows of different colors, a nozzle row having 1280 nozzles is provided for each color (for each color nozzle row). FIG. 6 is an explanatory view of the same; in the diagram, one square corresponds to 160 nozzles successive in the conveyance direction; symbol N1 indicates the first nozzle on the most downstream side (the discharge roller 12 side), and symbol N1280 indicates the $1280^{th}$ nozzle on the most upstream side (the conveyance roller 1 side). Symbols s1 through s8 indicate the order of main scanning by the recording head 4 conducted in the range illustrated. While in the diagram the nozzle row is depicted as if it makes a relative movement from above to below with respect to the recording position on the sheet in order to facilitate the illustration of the recording operation, in reality, the sheet moves in the direction A in the diagram.

In the region A, the recording is performed by using all the 1280 nozzles of the recording head in the region immediately before the region B. After the recording is performed by the first main scanning s1, the sheet is conveyed by a distance corresponding to 160 nozzles, and recording by the second main scanning s2 is carried out. From here onward, the conveyance of the sheet by a distance corresponding to 160 nozzles and recording by one main scanning are alternately effected, and the recording of the image of the same area is completed by eight main scanning operations (recording paths). In FIG. 6, the area (the area corresponding to 160 nozzles) where recording has been completed through eight scanning operations is shaded.

Figure 5C:
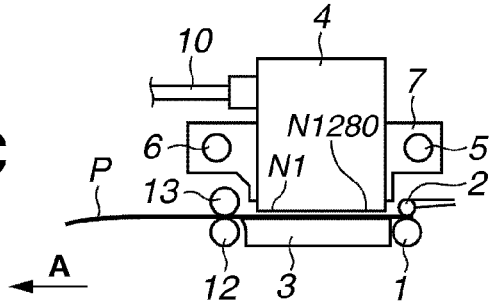
Figure 5D:
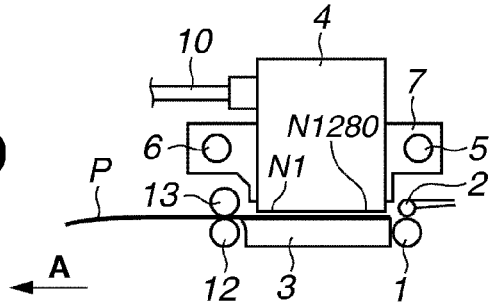

The region B in FIG. 4 is the region when switching is effected from the state in which the sheet P is conveyed by the two rollers of the conveyance roller 1 and the discharge roller 12 as illustrated in FIG. 5C (the first conveyance state), to the state in which the sheet is conveyed solely by the discharge roller 12 as illustrated in FIG. 5D (the second conveyance state). In the region B, a phenomenon can occur (referred to as a kick-off phenomenon) in which the trailing edge portion of the sheet P is kicked off at the moment when it leaves the conveyance roller 1 and the pinch roller 2 to cause shift of the image. Thus, in order that there may be no need to take into account such a phenomenon, the recording operation is performed so as not to cause any conveyance stop within a range of 3 mm before and after the nipping position between the conveyance roller 1 and the pinch roller 2. Thus, it suffices to conduct conveyance amount correction with respect to the conveyance state in which the trailing edge of the sheet P has reliably left the conveyance roller 1. This value of 3 mm before and after the nipping position between the conveyance roller 1 and the pinch roller 2 can be set based on an error in the trailing edge position of the sheet P; in the present exemplary embodiment, the setting to that value is made taking into all possible errors into account.

Figure 5E:
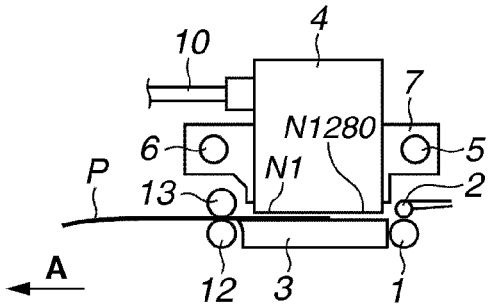

The region C in FIG. 4 is a region of the state (the second conveyance state) in which the sheet P is conveyed solely by the discharge roller 12 from the position of the sheet P illustrated in FIG. 5D to the position of the sheet P at the time of completion of the recording illustrated in FIG. 5E. Since the discharge roller 12 formed of rubber is used, the conveyance of the sheet P in the region C is subject to the influence of the offset error in the roller; further, since the pinching force by the discharge roller and the spur 13 is small, there is a fear of image deterioration. To prevent this, the one-time (one-recording-path) conveyance length (sub scanning amount) by the discharge roller 12 is restricted (shortened) from the length corresponding to 160 nozzles in the region A to a length corresponding to 64 nozzles.

Next, referring to FIG. 7, the recording operation and the conveyance operation when transition is effected from the region A to the region B and, further, to the region C will be described in more detail. As in FIG. 6, in the recording operation 900 in FIG. 7, one square represents 160 nozzles. In the recording operations of from 901 onwards, the blank squares indicate nozzle groups which are not used (restricted). Symbols s1 through s20 indicate the order of main scanning by the recording head 4 conducted in the range shown. Up to the recording operation 900 by the main scanning, which is s1 eight times of the recordings before the recording completion point in the region A, all the 1280 nozzles mentioned above are used. In the recording operations up to this, the scanning operations for performing the eight main scanning operations are all conducted by the two rollers of the conveyance roller 1 and the discharge roller 12. At the most upstream square where the next recording operation 901 is conducted, the conveyance between the seventh main scanning and the eighth main scanning is conducted solely by the discharge roller 12. In order to reduce the image deterioration due to this, the conveyance amount of the sheet P is reduced. To reduce the conveyance amount, the restriction of the number of used nozzles is started from the recording operation 901 by the main scanning s2. In the final square of the recording operation 901, the length in the conveyance direction corresponds to 128 nozzles. Regarding the squares where path recording has already been performed halfway through in a length corresponding to 160 nozzles, the nozzles on the downstream side are not used so that the path recording is performed likewise in a length corresponding to 160 nozzles.

The starting position of the recording operation 901 is determined through calculation of the distance from the trailing edge position of the sheet P. From the recording operation 901 to the recording operation 907, the number of squares each corresponding to 128 nozzles increases one by one, so that the number of nozzles used is reduced successively from the downstream side by 32 nozzles at one time. With this operation, the conveyance amount of the sheet P between the main scanning operations from the recording operation 901 to the recording operation 907 is reduced from an amount corresponding to 160 nozzles to an amount corresponding to 128 nozzles.

The trailing edge position of the sheet P at the point in time when the recording operation 907 is performed is shown in FIG. 5C; it is a position shifted upstream from the nipping position of the conveyance roller 1 and the pinch roller 2 by a distance (3 mm) corresponding to 144 nozzles. In the recording operation 907, the recording of the region B is conducted. In the recording operation 907, the recording of the square of a length corresponding to 160 nozzles is completed.

Next, the sheet P is conveyed to the starting position of the recording operation 908 by a distance (6 mm) corresponding to 288 nozzles. Thus, the starting position of the recording operation 908 is the position as shown in FIG. 5D; it is a position shifted downstream from the nipping position of the conveyance roller 1 and the pinch roller 2 by a distance (3 mm) corresponding to 144 nozzles. Even when conveyance has been conducted by an amount corresponding to 288 nozzles, path recording is performed in the recording operation 908 in the same manner as before, so that the nozzles used are shifted downstream.

From the recording operation 901 to the recording operation 907, a part of the conveyance between the path recordings of the squares is effected solely by the discharge roller 12. From the recording operation 908 onward, recording is performed in the region C, where all the conveyance between the path recordings is conducted solely by the discharge roller 12. In the region C, the conveyance amount is further reduced to perform conveyance by an amount corresponding to 64 nozzles at one time. Even when the conveyance amount is reduced, the nozzles used are shifted downward for each recording operation in order to continue the path recording of a length corresponding to 128 nozzles.

More specifically, as illustrated in FIG. 7, from the recording completion of the recording operation 908 to the recording operation 920, the number of used nozzles is restricted, whereby the conveyance by an amount corresponding to 64 nozzles and the recording by one main scanning (recording path) are conducted alternately, which is repeated until the recording of the image at the recording completion position 930 is completed. In the present exemplary embodiment, the recording completion position 930 is spaced apart from the trailing edge position of the sheet P by 3 mm, so that the trailing edge margin is 3 mm. The trailing edge margin amount can be set to some other value, e.g., 3 mm or less; by providing, for example, an ink receiving opening on the platen, it is also possible to conduct a non-margin recording of a trailing edge margin of 0 mm.

Next, the conveyance amount correction in the region A, the region B, and the region C of FIG. 4 will de described. The conveyance amount in the region A can be corrected for each kind of sheet. The conveyance correction amount is stored in the ROM 102 or the like in a unit of 1/9600 inch as a value per conveyance amount corresponding to 1280 nozzles; a value calculated in proportion to each conveyance amount is added in that unit. Further, regarding the correction amount, it is possible to set an appropriate value based on a test pattern or the like described below.

Figure 8:
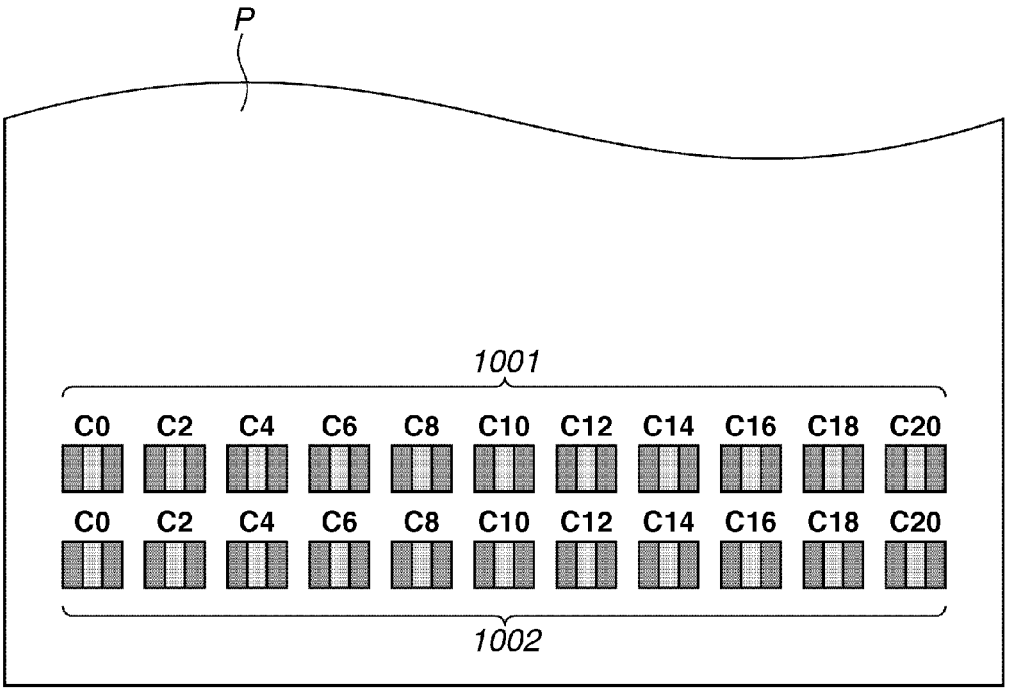
FIG. 8 is a diagram illustrating an example of a test pattern for setting a conveyance correction amount at a sheet trailing edge portion.
Figure 9A:
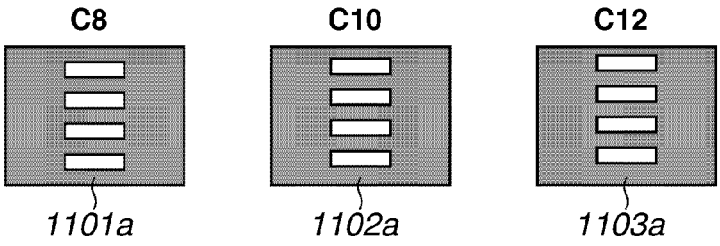
FIGS. 9A, 9B, and 9C are explanatory views illustrating a test pattern patch forming method.
Figure 9B:
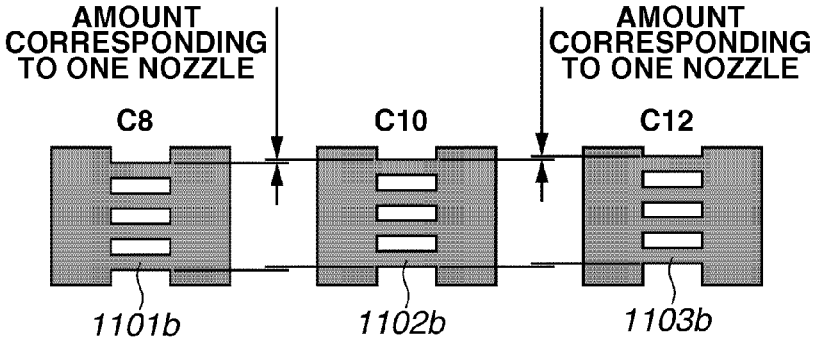
Figure 9C:
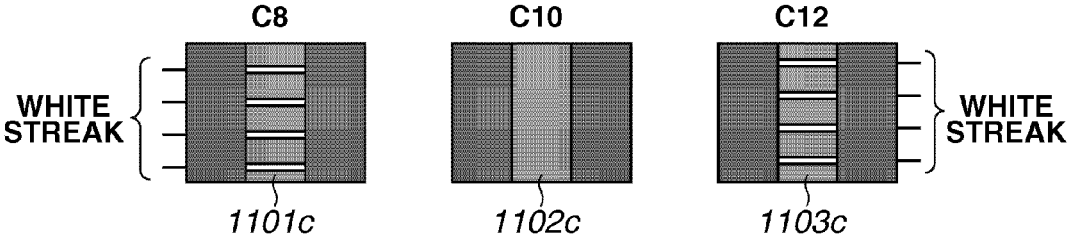
Figure 10:
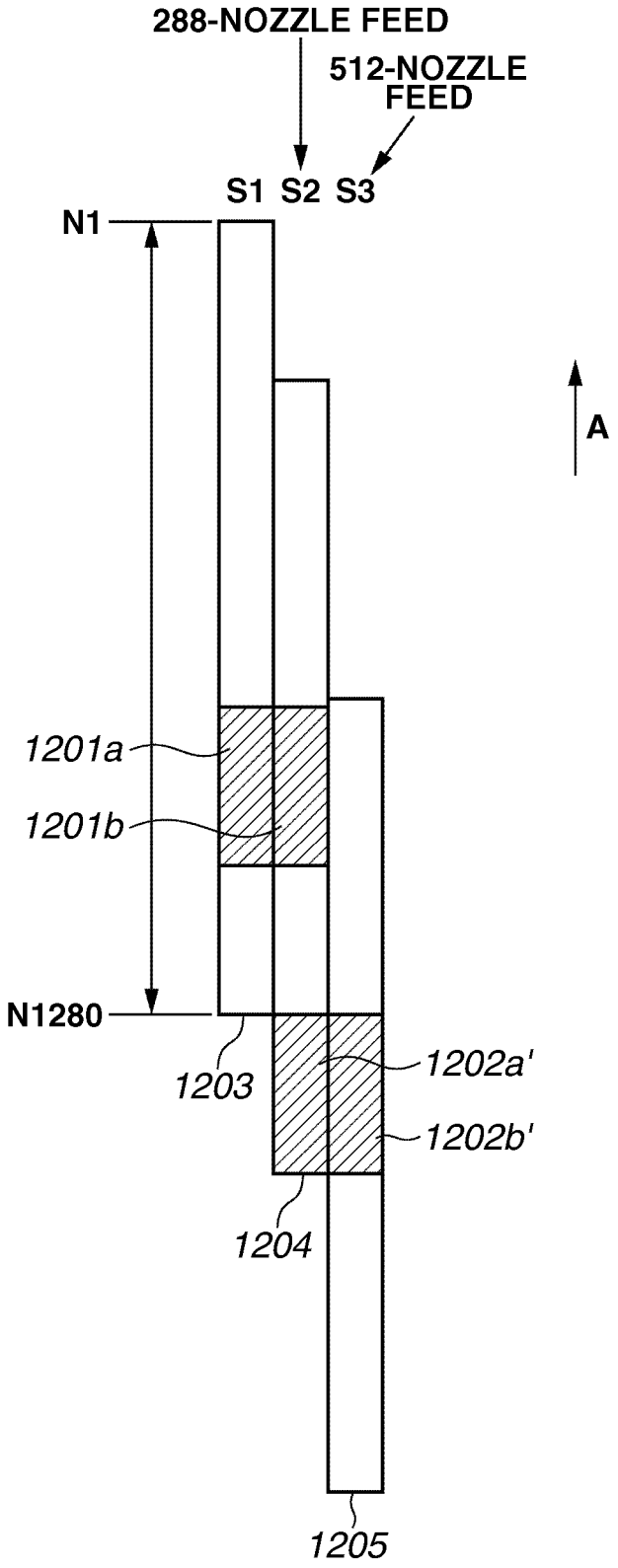
FIG. 10 is an explanatory view illustrating the recording operation and the conveyance operation when forming a test pattern.

Next, the correction of the conveyance amount in the region B and the region C will be described in detail. FIG. 8 is a diagram illustrating an example of a test pattern for setting the conveyance correction amount in the sheet trailing edge portion (the region B and the region C). FIGS. 9A through 9*c* are diagrams for illustrating a method of forming a patch of the test pattern of FIG. 8. FIG. 10 is a diagram for illustrating the recording operation and the conveyance operation when forming the test pattern. In FIG. 8, numeral 1001 indicates a pattern row allowing setting of a correction amount in the region B, and numeral 1002 in FIG. 8 indicates a pattern row allowing setting of a correction amount in the region C. These pattern rows are recorded at a position at a predetermined distance from the trailing edge of the sheet P used for the formation of the test pattern in correspondence with the recording of the region B and the region C. In each path of the pattern rows 1001 and 1002, symbols C0 through C20 are provided in which the number portions are two by two. The pattern rows 1001 and 1002 are of the same image pattern, and each pattern row is produced by recording in two main scanning operations.

Next, the recording operation and the conveyance operation when forming the pattern row 1001 and the pattern row 1002 illustrated in FIG. 8 will be described. The sheet P is conveyed to the position shown in FIG. 5C. In FIG. 5C, the trailing edge is at a position shifted upstream by 144 nozzles (approximately 3 mm) from the nipping position of the conveyance roller 1 and the pinch roller 2. In this state, the first scanning is conducted. In the first scanning, recording operation 1203 by the nozzle group 1201*a* illustrated in FIG. 10 is conducted.

FIG. 9A shows recording images recorded by the first main scanning in each of three patches of the pattern row 1001 and the pattern row 1002, i.e., the central patch and two patches adjacent thereto and on both sides thereof. In the recording operation 1203, the image is formed by the first main scanning of the pattern row 1001.

After the completion of the first main scanning, the sheet is conveyed through a distance (the region B) corresponding to 288 nozzles, and the sheet reaches the position shown in FIG. 5D. This is a position shifted downstream by 144 nozzles (3 mm) from the nipping position of the conveyance roller 1 and the pinch roller 2. Recording operation 1204 by the nozzle group 1201*b* and the nozzle group 1202*a*' is executed on the sheet at the position of FIG. 5D. By the nozzle group 1201*b*, the second main scanning recording of the pattern row 1001 is performed to complete the recording of the pattern row 1001. At the same time, the first main scanning recording of the pattern row 1002 is performed by the nozzle row 1202*a*'. The conveyance amount in the production of the pattern row 1001 in the test pattern is equal to the conveyance amount at the time of actual image production. After this, the sheet is conveyed through a distance corresponding to 512 nozzles (approximately 10.8 mm), and the third main scanning is performed. In the third main scanning, recording operation 1205 by the nozzle group 1202*b*' is conducted to complete the pattern row 1002. In this way, the pattern row 1001 is formed (recorded) by conducting conveyance through a distance corresponding to 288 nozzles (approximately 6 mm), which is the same as the region B, and the pattern 1002 is formed (recorded) by conducting conveyance through a distance corresponding to 512 nozzles (approximately 10.8 mm), which is the same as the region C.

Here, in the lateral-stripes-like pattern of the patch 1102*a* of the central portion of FIG. 9A, dots are arranged such that pattern of the patch 1102*a* is superimposed on the lateral-stripes-like pattern of the patch 1102*b* of the central portion of FIG. 9B at the same position so that a uniform halftone image like the patch 1102*c* of the central portion of FIG. 9C can be obtained. The patch 1101*a* and the patch 1103*a* are of the same pattern; however, regarding the patch 110*b*, the lateral-stripes-like pattern of the central portion is arranged so as to be shifted downwards by one dot at a density of 1200 dpi, and, regarding the patch 1103*b*, it is arranged likewise so as to be shifted upwards by one dot. Thus, when the patch 1101*a* is superimposed on the patch 1101*b* at the same position, white streaks are generated in the halftone image as shown in the patch 1101*c*. Similarly, also when the patch 1103*a* is superimposed on the patch 1103*b*, white streaks are generated in the halftone image as shown in FIG. 1103*c*.

In FIGS. 9A through 9C, in the case in which the patch 1102*c* exhibits a uniform halftone image, no error occurs in the conveyance from the position where the patch 1102*a* is formed, to the position where the patch 1102*b* is formed. Thus, in a case, for example, in which the conveyance amount is larger by, for example, one nozzle, that is, (1/120) inch, the patch 1103*c* provides a uniform halftone image. Conversely, when the conveyance amount is smaller by (1/1200) inch, the patch 1101*c* provides a uniform halftone image.

In FIG. 8, in each of the pattern row 1001 and the pattern row 1002, eleven patches are arranged in the main scanning direction. And, these patches are formed in a dot arrangement in which they are vertically shifted successively by 1 through 5 dots with respect to the central patch (C10), one dot being of a density of 1200 dpi. More specifically, it is possible to identify a conveyance error of ±5 nozzles (in the unit of 1200 dpi) with respect to conveyance errors in the regions B and C. While the numbers affixed to the patches of FIG. 8 are all even numbers, in a case in which the adjacent patches are similarly uniform halftone images, the odd number between them is selected (e.g., C11 between C10 and C12). As a result, it is possible to recognize up to a conveyance error of 0.5 nozzles in the unit of 1200 dpi.

Figure 11A:
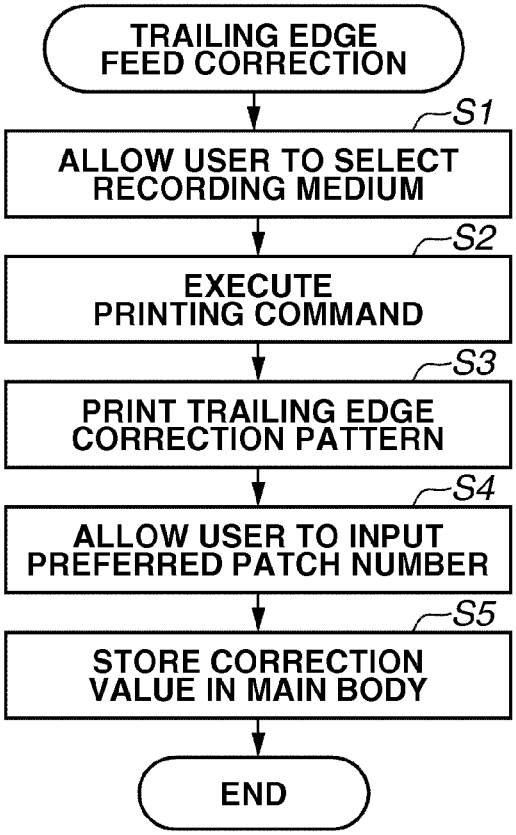
FIG. 11A is a flowchart illustrating procedures for test pattern formation and correction amount setting.
Figure 11B:
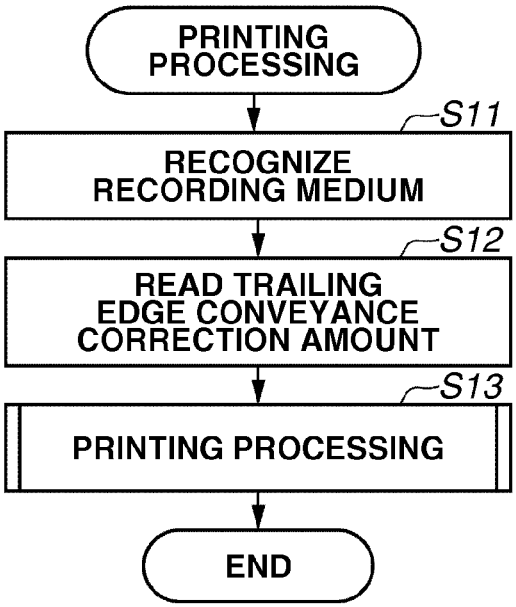
FIG. 11B is a flowchart illustrating printing processing procedures using a set conveyance correction amount.

Next, the formation (recording) of a test pattern and a correction amount setting processing based thereon will be described. FIG. 11A is a flowchart illustrating processing for test pattern formation and correction amount setting, and FIG. 11B is a flow chart illustrating printing processing using the set conveyance correction amount. The control unit is provided with a table indicating a correction amount for each conveyance amount correction parameter; in the present exemplary embodiment, the conveyance correction amount is all stored in the unit of 960 dpi as stated above. In FIG. 11A, the user sets, in step S1, a sheet on which he wishes to make an adjustment in the region B and the region C, and inputs information about its type. Next, he gives, in step S2, a printing start command, whereby a test pattern as illustrated in FIG. 8 is printed (recorded). The user visually checks the printing result, and inputs, in step S4, the number of the most preferable patch (in which the white streaks are least conspicuous and in which a uniform halftone is reproduced). Based on the input value, the correction value which has already been stored is rewritten in step S5 to be updated and stored. By using the correction amount thus stored, it is possible to perform the printing processing of FIG. 11B. Information for recording these test patterns is stored in a first storage unit.

Figure 12:
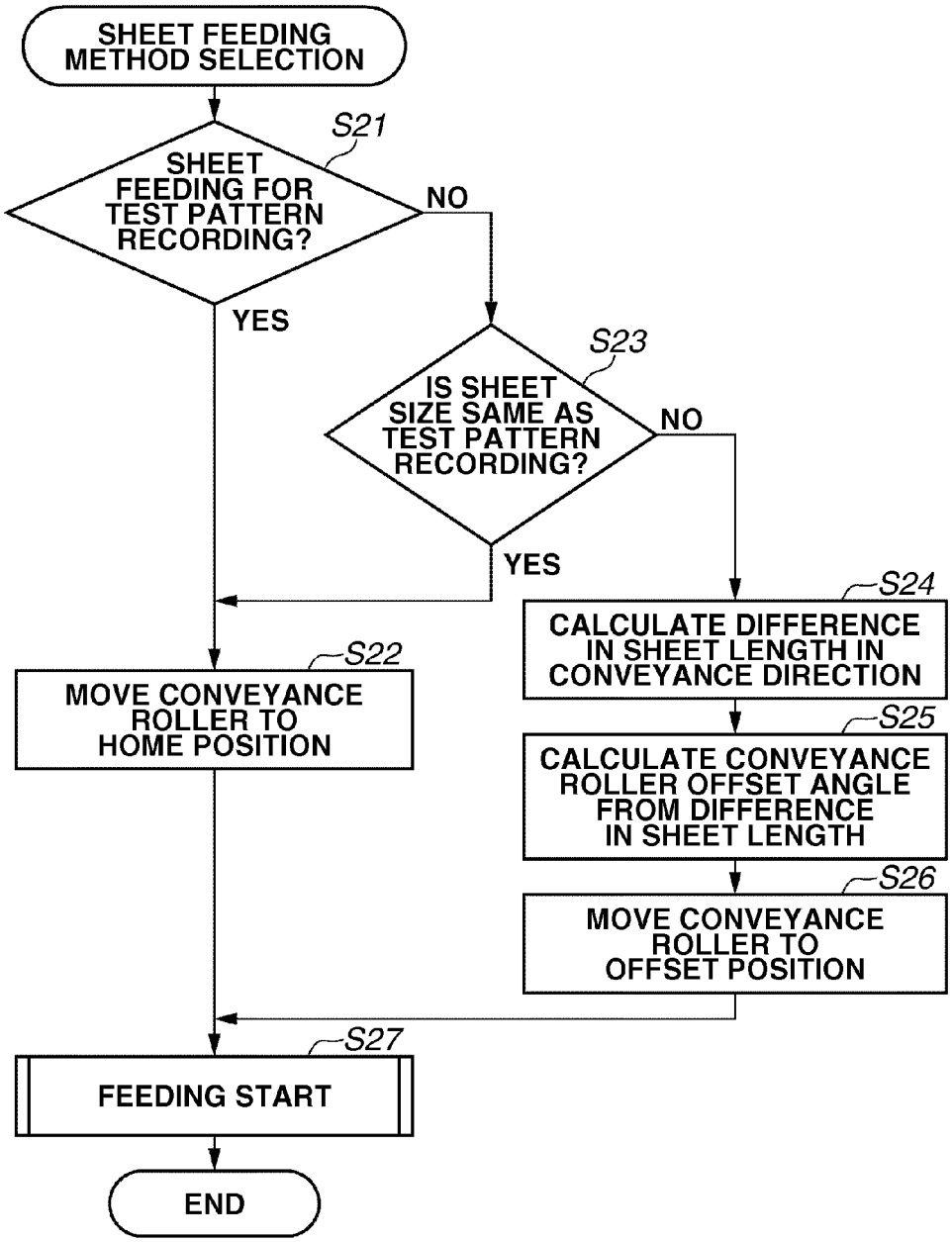
FIG. 12 is a flowchart illustrating a processing unit for determining a sheet feeding method.
Figure 14:
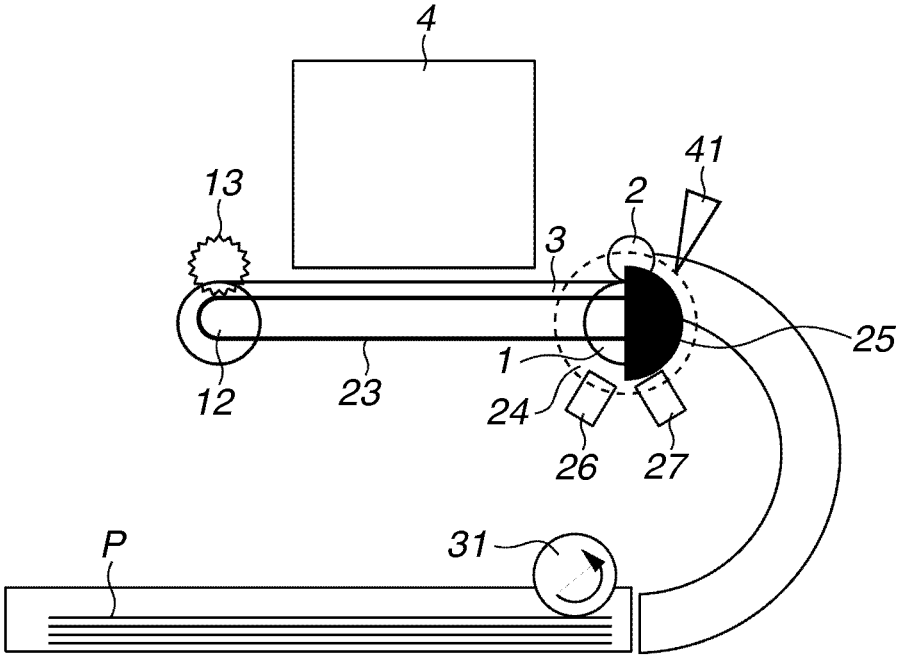
FIG. 14 is a longitudinal sectional view of the ink jet recording apparatus of the first exemplary embodiment.

Next, a control unit for attaining a fixed rotating position for the discharge roller 12 according to the present exemplary embodiment will be described. FIG. 12 is a flowchart illustrating a processing unit for determining the sheet feeding method. FIG. 13 is a table showing the relationship between the sheet size and the offset angle of the conveyance roller. FIG. 14 is a vertical sectional view of the ink jet recording apparatus of the first exemplary embodiment. Here, referring to FIGS. 12 through 14, a case will be described by way of example in which a test pattern is recorded in the letter size (215.9×297 mm), and the actual recording is performed in three sizes of the letter size, the A4 size (210×297 mm), and the legal size (215.9×355.6 mm).

In FIG. 12, when the selection of the sheet feeding method is started, it is checked (determined) in step S21 as to whether the object of the feeding is the recording of a test pattern or not. In the case of the recording of a test pattern, the conveyance roller 1 is moved to a home position in step S22. And, the feeding of the sheet is started in step S27. As illustrated in FIG. 14, a feeding roller 31 as a feeding unit is provided on the still more upstream side of the upstream side conveyance unit of the recording apparatus, and the conveyance roller 1 and the feeding roller 31 are driven separately. After the conveyance roller 1 has been brought to a stop at the home position, the sheet feeding roller 31 is driven to feed the sheet P to the conveyance roller 1. In the case in which the conveyance roller 1 and the sheet feeding roller 31 are sufficiently spaced apart from each other, driving of the both rollers may overlap with each other. In the state in which the sheet P has been fed to reach the conveyance roller 1, the driving of the conveyance roller 1 is started. By doing so, it is possible to attain a fixed rotating position of the conveyance roller 1 when the leading edge of the sheet P leaves the upstream side conveyance unit.

As another method, it is also possible to supply the sheet to the upstream side conveyance unit through manual feed operation by the user without providing the sheet feeding roller 31. Further, as a control unit for controlling the rotating position of the conveyance roller 1, it is also possible to feed the sheet while rotating the conveyance roller 1 in a direction opposite to the conveyance direction, by controlling the rotating position through normal rotation at the rotating position where the conveyance roller 1 has reached the home position, with the leading edge abutting thereon. In other words, other methods can be adopted so long as it is possible to effect control such that the rotating position of the conveyance roller 1 is fixed when the leading edge of the sheet leaves the upstream side conveyance unit. In this way, the rotating position of the conveyance roller 1 is fixed when the trailing edge of the sheet leaves the upstream side conveyance unit, in other words, when switching is effected from the first conveyance state to the second conveyance state. Further, as illustrated in FIG. 2, the conveyance pulley 21 and the discharge pulley 22 are of the same diameter, so that the rotating position of the discharge roller 12 is also fixed when switching is effected from the first conveyance state to the second conveyance state. Further, while in the case illustrated in FIG. 2 the conveyance pulley 21 and the discharge pulley 22 are of the same diameter, the diameter of the discharge pulley may be an integral fraction of the conveyance pulley. In this case, while the conveyance roller 1 makes one rotation, the discharge roller 12 makes integer rotations, so that, in this case also, the rotating position is fixed when switching is effected from the first conveyance state to the second conveyance state. The correction amount of the test pattern recorded by the above-described method is calculated by the above-described method, and the correction value is stored in the storage unit for each sheet size or each sheet kind.

In FIG. 12, when it is determined in step S21 that the object of the sheet feeding is not the recording of a test pattern but an arbitrary recording (NO in step S21), the sheet size in which the sheet feeding is performed is checked in step S23. When the sheet size is the same as that in the test pattern recording, the conveyance roller 1 is moved to the home position in step S22, and the feeding is started in step S27. At this time, the rotating position of the conveyance roller 1 when the leading edge of the sheet leaves the upstream side conveyance unit is the same as that at the time of test pattern recording. The length in the conveyance direction of the sheet is the same as that at the time of test pattern recording, so that the rotating position of the conveyance roller 1 and the discharge roller 12 when the trailing edge of the sheet leaves the upstream side conveyance unit, in other words, when switching is effected from the first conveyance state to the second conveyance state, is the same as that at the time of test pattern recording.

In this way, in the present exemplary embodiment, when performing an arbitrary recording, control is effected by the control unit 100 such that the rotating position of the drive side roller (discharge roller) 12 on the downstream side conveyance unit is the same as that at the time of test pattern recording, when the sheet trailing edge leaves the upstream side conveyance unit (the conveyance roller 1 thereof). In this case, in the present exemplary embodiment, the drive side roller (conveyance roller) 1 of the upstream side conveyance unit and the drive side roller (discharge roller) 12 of the downstream side conveyance unit are driven by the same drive source. And, the ratio of the diameter A of the drive transmission member of the upstream side conveyance unit (e.g., the conveyance pulley 21 of FIG. 2) to the diameter B of the drive transmission member of the downstream side conveyance unit (e.g., the discharge pulley 22 of FIG. 2), A/B, is an integer. Thus, when performing an arbitrary recording, the influence of the offset of the conveyance roller and the discharge roller is the same as that at the time of test pattern recording. Thus, when performing conveyance in the region B and the region C, the correction amount calculated based on the test pattern proves effective, so that it is possible to obtain a satisfactory image in a stable manner.

FIG. 13 is a table illustrating an example of the relationship between the sheet size and the conveyance roller offset angle. When the sheet length differs from that at the time of test pattern recording, the difference in sheet length in the conveyance direction is calculated in step S24. For example, when performing recording (arbitrary recording) in the A4 size, the length involved is 17.6 mm larger than that of the letter size, in which the test pattern has been recorded. Next, in step S25, the offset angle is calculated. In the present exemplary embodiment, the circumferential length (hereinafter also referred to as the peripheral length) of the conveyance roller 1 is 40 mm, so that the requisite rotation angle of the conveyance roller 1 for the conveyance through the distance of 17.6 mm, which is the difference in sheet length, is 158.4 degrees. In the case of the legal size, the sheet length in the conveyance direction is 76.2 mm larger than that in the case of the letter size, and larger than the peripheral length of 40 mm of the conveyance roller 1 in the present exemplary embodiment. In this case, the offset angle (325.8 degrees) is calculated after subtracting 40 mm. This also applies to the case where the difference in sheet length is 80 mm or more, or 120 mm or more. And, in step S26, the rotation phase of the conveyance roller 1 at the start of conveyance is adjusted such that when the sheet trailing edge passes the conveyance roller 1, the rotation phase of the conveyance roller 1 is the same as that at the time of test pattern recording. For example, in the case of a sheet of the A4 size, the conveyance roller 1 is rotated 158.4 degrees more than in the case of a sheet of the letter size, whereby the sheet trailing edge passes the conveyance roller 1. Thus, the rotation phase of the conveyance roller 1 is previously adjusted such that the sheet conveyance is started from a rotation phase 158.4 degrees before the home position. More specifically, the conveyance roller 1 is kept at rest at a rotation phase attained through rotation from the home position by 201.6 degrees. And, in step S27, when the leading edge of the sheet fed by the feeding roller 31 reaches the conveyance roller 1, the conveyance by the conveyance roller 1 is started.

In the present exemplary embodiment described above, a first storage unit storing the sheet size for test pattern recording (which, in FIG. 13, is the letter size), and a second storage unit storing the sheet sizes for arbitrary recording (which, in FIG. 13, are the A4 size and the legal size) are provided. In addition, a calculation unit for obtaining the difference in sheet size (the difference from the test pattern of FIG. 13) between the first storage unit and the second storage unit is provided. And, when performing an arbitrary recording, the rotating position of the drive side roller of the downstream side conveyance unit when the sheet leading edge leaves the upstream side conveyance unit is offset as compared with the rotating position at the time of test pattern recording, by an amount of the rotating position required for conveyance corresponding to the difference of the sheet size obtained by the above calculation unit. More specifically, when recording is performed in the A4 size, the rotation phase of the conveyance roller 1 is previously shifted in a direction opposite to the conveyance direction by an amount corresponding to the requisite rotation angle for conveyance by 17.6 mm from the rotation phase at the time of test pattern recording. When performing recording in the legal size, the rotation phase at the time of conveyance start of the conveyance roller 1 is previously shifted from that at the time of test pattern recording, in a direction opposite to the conveyance direction by an amount corresponding to the requisite rotation angle (325.8 degrees) for conveyance by 76.2 mm.

In the above control method, even in the case of a sheet size different from the test pattern, it is possible to make the rotation phase of the conveyance roller 1 and the discharge roller 12 when switching from the first conveyance state to the second conveyance state, the same as that at the time of test pattern recording. Thus, the influence of the offset of the conveyance roller and the discharge roller is the same as that at the time of test pattern recording. Thus, when conveyance is performed in the region B and the region C, the correction amount calculated from the test pattern proves effective, so that it is possible to obtain a satisfactory image in a stable manner. In other words, it is possible to make the rotating position of the drive side roller of the downstream side conveyance unit, the same as that at the time of test pattern recording, when the trailing edge of the sheet leaves the nipping portion of the upstream side conveyance unit. As a result, it is possible to perform the conveyance using solely the downstream side conveyance unit at the same rotating position as that at the time of test pattern recording, so that it is possible to effect a high precision recording in which variation in conveyance amount due to offset of the roller of the downstream side conveyance unit is reduced, making it possible to prevent deterioration in image quality.

The sheet feeding method of the present exemplary embodiment is to be executed solely when the region B and the region C are recorded, so that, in the case of recording data of a large trailing edge margin, roll paper printing, etc., the sequence of FIG. 12 may be omitted, directly starting the feeding operation. Further, the procedures illustrated in FIG. 11A may be started as appropriate by the user, or started at an appropriate time according to other conditions, or started in relation to other processing operations. For example, when the user desires printing, selects a sheet, and starts the execution of the printing processing, transition to printing is effected as it is in a case where the correction amount and the offset amount with respect to the sheet have already been set (stored). Otherwise, it is also possible to demand the execution of the processing of FIG. 11.

The processing of FIG. 11A may be started by an operation unit on the recording apparatus side, or started from a printer driver setting screen operated by the host apparatus. Further, the correction amount and the offset amount are set with respect to the recording apparatus; for example, they may be set/stored in a storage unit consisting, for example, of the EEPROM 103 of the recording apparatus or in the storage unit of the printer driver or the like of the host apparatus 1000. In the latter case, when the host apparatus 1000 supplies printing data, etc. to the recording apparatus at the time of printing processing, these items of data can be included and supplied.

Figure 15:
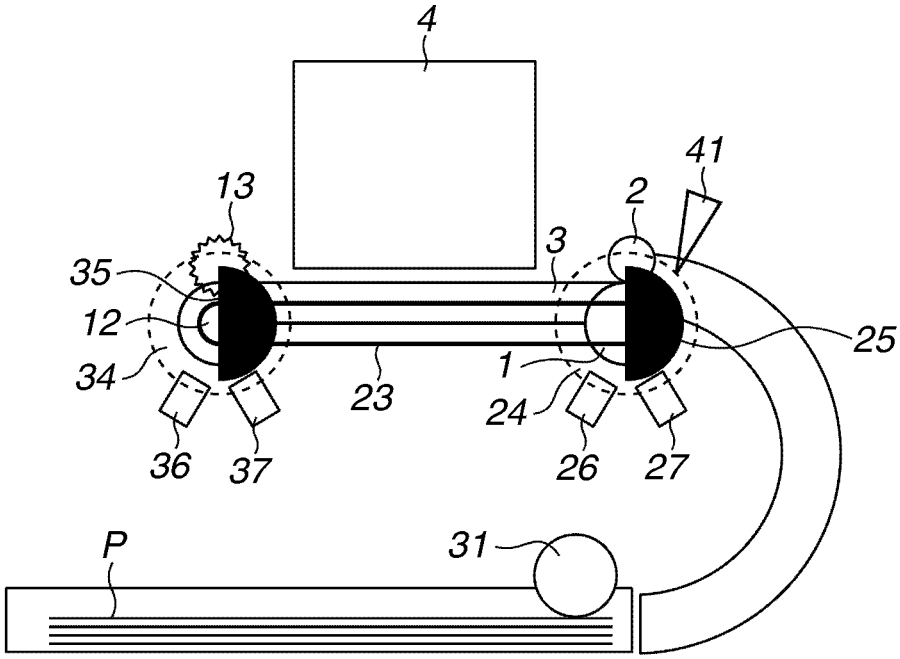
FIG. 15 is a longitudinal sectional view of an ink jet recording apparatus according to a second exemplary embodiment.

FIG. 15 is a longitudinal sectional view of an inkjet recording apparatus according to the second exemplary embodiment. In the present exemplary embodiment, in addition to the construction of the first exemplary embodiment, a construction for rotating position control is also provided in the downstream side conveyance unit. More specifically, as illustrated in FIG. 15, in the present exemplary embodiment, in addition to an upstream side conveyance unit similar to that of the first exemplary embodiment, a code wheel 34, a home position mark 35, an encoder 36, and a home position sensor 37 are attached to the discharge roller 12, which is the drive side roller of the downstream side conveyance unit. Otherwise, the present exemplary embodiment is of the same construction as the first exemplary embodiment, and in the following, the differences from the first exemplary embodiment will be described In the present exemplary embodiment, when performing a control operation corresponding to the flowchart of FIG. 12, control is effected using the discharge roller 12 as a reference instead of using the conveyance roller 1 as a reference in steps S22, S25, and S26 of FIG. 12. As described with reference to FIG. 2, in the first exemplary embodiment, it is necessary to make the conveyance pulley 21 and the discharge pulley 22 of the same diameter, or make the peripheral length an integral ratio. In the present exemplary embodiment, however, the discharge roller 12 is also provided with a construction for controlling the rotating position, so that the relationship between the diameter of the conveyance pulley 21 and that of the discharge pulley 22 may be an arbitrary one. In this construction, the rotating position of the discharge roller 12 can be fixed when switching is effected from the first conveyance state to the second conveyance state, whereas the rotating position of the conveyance roller 1 is not fixed. However, as described above, the offset amount of the conveyance roller 1 is smaller as compared with that of the discharge roller 12. More specifically, by reducing the influence of the discharge roller 12, which shows a large offset amount, it is possible to stabilize the conveyance accuracy of the whole. Thus, also in the present exemplary embodiment, it is possible to perform a high precision conveyance in which variation in conveyance amount due to offset of the roller of the downstream side conveyance unit is reduced, thus providing the same effect as the first exemplary embodiment.

In the present exemplary embodiment, like the upstream side conveyance unit, the code wheel 34 and the encoder 36 can be controlled in a unit of 1/9600 inch. In the second conveyance state, the conveyance control of the sheet P is effected by using the encoder 36 provided in the downstream side conveyance unit. However, it is not always necessary for the conveyance resolution of the downstream side conveyance unit to be at a similar level to the upstream side conveyance unit. Further, it is also possible to remove the encoder 36 from the downstream side conveyance unit, and to perform solely the detection of the home position by the downstream side conveyance unit, performing conveyance control by using the encoder 26 of the upstream side conveyance unit also in the second conveyance state.

Figure 16A:
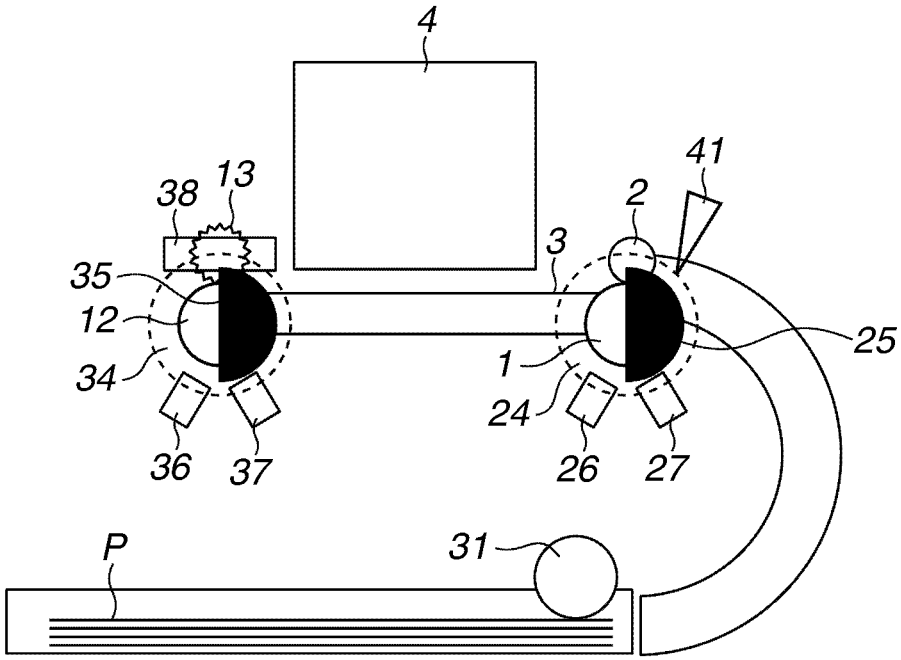
FIGS. 16A and 16B are longitudinal sectional views of an ink jet recording apparatus according to a third exemplary embodiment.
Figure 16B:
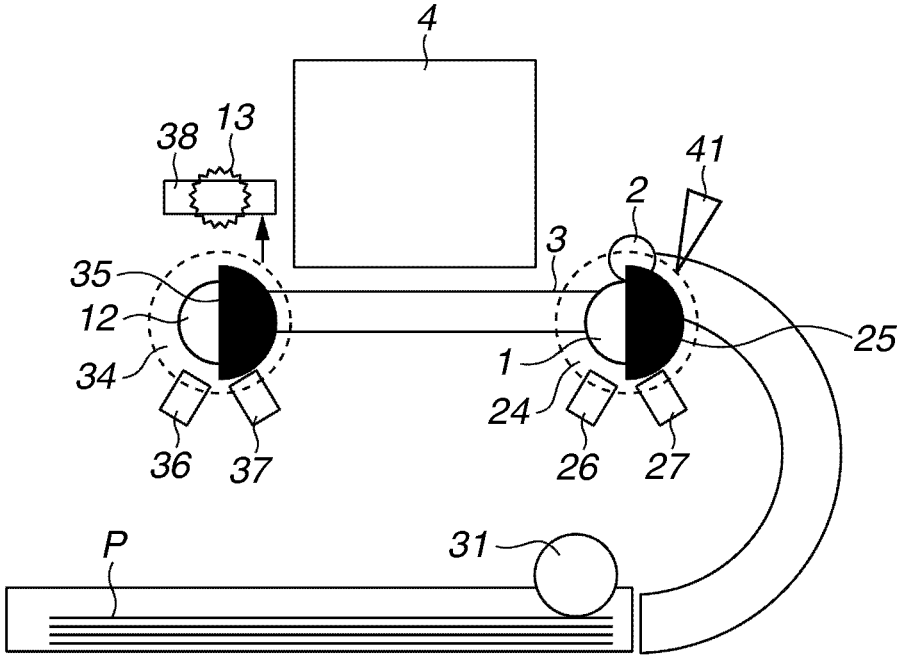

FIGS. 16A and 16B are longitudinal sectional views of an ink jet recording apparatus according to the third exemplary embodiment; FIG. 16A illustrates a state in which the spur 13 is pressed by the discharge roller 12; and FIG. 16B illustrates a state in which the spur 13 is spaced apart from the discharge roller 12. FIG. 17 is a table illustrating an example of the movement of the discharge roller and the spur of the ink jet recording apparatus of the third exemplary embodiment. In the present exemplary embodiment, the spur 13 according to the second exemplary embodiment is capable of ascending and descending. More specifically, the spur 13 is accommodated in a spur holder 38, and can be raised and lowered together with the spur holder 38 by a cam (not illustrated). Otherwise, this exemplary embodiment is the same as the first exemplary embodiment, and the following description will mainly center on the differences. FIG. 16A illustrates a state in which the spur 13 has been lowered to form the nipping portion (sheet pinching portion) together with the discharge roller 12. FIG. 16B illustrates a state in which the spur has been raised to be spaced apart from the discharge roller 12, forming no nipping portion. The conveyance roller 1 and the discharge roller 12 are rotated by motors which are separately driven, so that the conveyance belt 23 as used in the first and the second exemplary embodiments is not used.

Next, a recording method according to the present exemplary embodiment will be illustrated with reference to FIG. 17. Until the trailing edge of the sheet P passes a sheet determination sensor 41, the recording is performed in the state of step S31 of FIG. 17. This state corresponds to FIG. 16B (The recording sheet P being recorded is not illustrated). At this time, the spur S13 ascends, and is spaced apart from the discharge roller 12, and the conveyance roller 1 and the discharge roller 12 are rotating in the same direction (conveyance direction), with no nipping between the discharge roller 12 and the spur 13. When the trailing edge of the sheet P reaches the sheet determination sensor 41, the processing proceeds to step S32. In step S32, the discharge roller 12, which has been rotating, is stopped at the home position. After this, the sheet P is conveyed by rotation of the conveyance roller 1 while it receives frictional resistance of the stopped discharge roller 12.

When the trailing edge of the sheet P reaches a position 10 mm upstream the conveyance roller 1, the processing proceeds to step S33. The trailing edge position of the sheet P is calculated with the code wheel 24 and the encoder 26 of the upstream side conveyance unit. Here, the spur 13 is lowered to be brought into pressure contact with the discharge roller 12 to attain the state of FIG. 16A. At the same time, the discharge roller 12 starts to rotate again. At this time, the discharge roller 12 starts to rotate from the home position in the same direction as the conveyance roller 1. When conveyance is effected by 10 mm after the restart of the discharge roller 12, the first conveyance state is switched to the second conveyance state. More specifically, at the rotating position where the discharge roller 12 has been rotated from the home position by an amount corresponding to 10 mm, the first conveyance state is switched to the second conveyance state.

Thus, also in the present exemplary embodiment, as in the first and second exemplary embodiments, it is possible to make the rotating position of the drive side roller of the downstream side conveyance unit the same as that at the time of test pattern recording, when the sheet trailing edge leaves the nipping portion of the upstream side conveyance unit. As a result, the conveyance solely by the downstream side conveyance unit can be performed at the same rotating position as the test pattern recording, so that it is possible to perform a high precision conveyance in which variation in the conveyance amount due to offset of the roller of the downstream side conveyance unit is reduced, making it possible to prevent deterioration in image quality.

In this way, in the present exemplary embodiment, the nipping portion of the roller pair (the discharge roller 12 and the spur 13) can be switched between the pinching state and the released state. And, at the point in time when the trailing edge of the sheet P reaches a position on the upstream side of the nipping portion of the roller pair (the conveyance roller 1 and the pinch roller 2) at a predetermined distance, the nipping portion of the roller pair of the downstream side conveyance unit is switched from the released state to the pinching state. In the present exemplary embodiment, recording on each sheet (inclusive of arbitrary recording and test pattern recording) is carried out by using such a control unit, so that it is possible to mitigate the variation in the conveyance amount due to offset of the roller of the downstream side conveyance unit. Thus, it is possible to perform a high precision conveyance, making it possible to prevent deterioration in image quality.

Further, in the third exemplary embodiment, the rotating position control on the discharge roller 12 is effected during recording, so that an improvement in terms of throughput is to be expected. Further, since there is no need to check the size of the sheet on which recording is to be performed, it is possible to omit the procedure for the user to input the sheet size, thereby simplifying the operation and reducing operational errors. Further, this exemplary embodiment is also applicable to sheets of a size other than the standard size such as the A4 size or the letter size, so that an improvement in terms of conveyance accuracy for various sheets is to be expected. While in the present exemplary embodiment the processing proceeds to step S32 and to step S33 with timing within a range as shown in FIG. 17, this range should not be construed restrictively. More specifically, it is also possible to operate the discharge roller 12 and the spur 13 with other timing so long as the rotating position of the discharge roller 12 is fixed when the first conveyance state is switched to the second conveyance state.

In the present exemplary embodiment, in addition to the control for mitigating the influence of roller offset as effected in the first through third exemplary embodiments described above, control is executed to effect correction regarding the sheet conveyance resistance, which differs from sheet size to sheet size. In the present exemplary embodiment also, the control unit for mitigating the influence of roller offset is the same as that in the first through third exemplary embodiments. Except that correction is executed on the conveyance resistance, which differs from sheet size to sheet size, the present exemplary embodiment is the same as the first through third exemplary embodiments described above, so that, in the following, mainly the control unit for effecting correction regarding conveyance resistance will be described in detail.

When the sheet size (more specifically, the sheet size in the main scanning direction) differs, the conveyance resistance is changed when the first conveyance state is switched to the second conveyance state, so that, in some cases, the amount by which the conveyance amount is to be corrected is changed. This tendency is particularly conspicuous in the case of a thick sheet; in some cases, it is necessary to record the test pattern for each sheet size, obtaining an optimum correction amount for each sheet size. In view of this, in the present exemplary embodiment, control is performed so as to effect correction also regarding the sheet conveyance resistance, which differs according to the sheet size.

FIGS. 18A and 18B are tables showing examples of a table storing a conveyance correction amount for each sheet size (the length in the main scanning direction) in an ink jet recording apparatus according to a fourth exemplary embodiment. FIG. 18A shows a table storing a correction amount (correction value) for each standard sheet size, and FIG. 18B is a table storing a correction amount (correction value) for each different length in the main scanning direction. While both the methods of FIGS. 18A and 18B are acceptable, the method of FIG. 18B may be more preferable in that it is also applicable to a sheet of an arbitrary size such as a sheet prepared by the user. The correction amount can be stored for each kind of sheet (ordinary paper sheet, coated paper sheet, glossy paper sheet, etc.) respectively. As shown in FIGS. 18A and 18B, in the recording apparatus, it is possible to store the correction amount for the region B and the correction amount for the region C of FIG. 4 for each of the sheet sizes classified into different lengths in the main scanning direction.

While it is also possible to previously store correction amounts in the table of FIGS. 18A and 18B, in the following description, it will be assumed that no correction amount is stored in the initial stage. More specifically, it is not until the user executes the processing illustrated in FIG. 11A that the values of the correction amounts are set and stored in the tables of FIGS. 18A and 18B. FIGS. 18A and 18B indicate that the setting operation of FIG. 11A has been performed on sheets of the A4 size and the B4 size. In the correction amount calculation method described below, the correction amount is stored (the procedures of FIG. 11A are executed) by performing test pattern recording using sheets of the A4 size and the B4 size, and then arbitrary recording is performed in the A4 size, the letter size, and the B5 size.

First, the case in which test pattern recording is performed on an A4 size sheet will be described. When it is determined in step S21 of FIG. 12 that the sheet feeding is performed to record a test pattern (YES in step S21), the conveyance roller (the drive side roller of the first conveyance unit) 1 is moved to the rotating position corresponding to the home position in step S22. Then, test pattern recording is performed to calculate the correction amount of the region B and the correction amount of the region C. In the method of FIG. 18A, the calculated correction value is stored in the A4 area, and, in the method of FIG. 18B, it is stored in the area corresponding to 201 mm to 250 mm. Next, a test pattern is recorded on a sheet of the B4 size, and the correction value calculated in a similar manner is stored in the B4 area in the method of FIG. 18A, and in the area corresponding to 251 mm to 300 mm in the method of FIG. 18B. These correction values thus stored are stored as they are until the test pattern recording is performed again in the same region (size) or on the sake kind of sheet. Here, the correction value of the region B is a value per 288 nozzles stored in a unit of 1/9600 inch, and the correction value of the region C is a value per 1280 nozzles stored in a unit of 1/9600 inch.

Next, the correction amount calculation method when arbitrary recording is performed on sheets of the A4 size, the letter size, and the B5 size in this state will be described. When performing recording on a sheet of the A4 size, the correction amount for the A4 size recording stored in FIGS. 18A and 18B is adopted as it is. In the case of recording in the letter size, in the method of FIG. 18A, the correction amount of the A4 size is adopted, which is of the sheet size in the main scanning direction closest among the correction amounts already calculated. On the other hand, in the method of FIG. 18B, the correction amount stored in the area of 201 mm to 250 mm is adopted, which is the same as the A4 size. Further, in the case of recording in the B5 size, in both the methods of FIGS. 18A and 18B, the correction value of the closest area (size) is adopted. More specifically, in the method of FIG. 18A, the correction amount of the A4 size (210 mm) is used, and, in the method of FIG. 18B, the correction amount in the column corresponding to the area of 251 mm to 300 mm is used.

In the present exemplary embodiment, the conveyance correction amount when performing conveyance solely by the downstream side conveyance unit can be stored for each sheet size, and, with respect to the sheet size for which the correction amount has been calculated and stored, the conveyance amount is corrected by using that correction amount. On the other hand, with respect to the sheet size for which the correction amount has not been calculated yet, the conveyance amount is corrected by using the correction amount of the sheet size whose length in the main scanning direction is the closest of all the sheet sizes for which the correction amounts have already been calculated. Further, in the present exemplary embodiment, the conveyance correction amount when performing conveyance solely by the downstream side conveyance unit can be stored while classified into a plurality of portions according to the length in the main scanning direction, and, with respect to the classification for which the correction amount has already been calculated and stored, the conveyance amount is corrected by using that correction amount. On the other hand, with respect to the classification for which the correction amount has not been calculated yet, the conveyance amount is corrected by using the correction amount of the classification whose length in the main scanning direction is the closest of all the classifications for which the correction amounts have already been calculated.

Such correction amount control is executed solely with respect to a sheet size in which the test pattern recording has not been recorded yet. When the test pattern is recorded in the same size, the correction amount control is completed at that moment, and the correction amount obtained from the test pattern is used as it is. In the present exemplary embodiment, in addition to the influence of the roller offset in the first through third exemplary embodiments, also with respect to the conveyance resistance of the sheet, which differs according to the sheet size, it is possible to effect a simple correction by using the correction values of the sheet sizes that have been calculated, thus making it possible to obtain a satisfactory image in a still more stable manner.

FIG. 19 is a table showing an example of a table storing the offset amounts of the conveyance correction amounts of an ink jet recording apparatus according to a fifth exemplary embodiment. In the present exemplary embodiment, a method is adopted in which, in the conveyance amount correction of the fourth exemplary embodiment described above, a correction amount determined according to a difference in the length in the main scanning direction is further added to the correction amount of the classification size whose length in the main scanning direction is the closest of all the classification sizes for which the correction amounts have already been calculated. FIG. 19 is a table (offset table) showing an example of the added correction amounts (offset amounts). Otherwise, the present exemplary embodiment is of the same construction and operation as the fourth exemplary embodiment, and, in the following, mainly the differences will be described in detail.

In FIG. 19, the vertical axis indicates the sheet size of the correction amount which has been calculated, and the horizontal axis indicates the sheet size of a sheet on which recording is to be performed and whose correction amount has not been calculated yet. This offset table is previously incorporated into the storage unit or the like of the apparatus main body, and an appropriate one is selected from among a plurality of tables according to a type of sheet. In the method described below, the conveyance correction amount set and stored by performing test pattern recording using a sheet of the A4 size, and then the conveyance correction amount in the case where arbitrary recording is performed in the B5 size are calculated. In this case, the value given at the portion where the A4 of the vertical axis and the B5 of the horizontal axis cross each other is the offset value (offset amount), which is given in a unit of 1/9600 inch. More specifically, in the example shown, in the unit of 1/9600 inch, the correction value with respect to the region B is −2, and the correction value with respect to the region C is −10.

In a case where there is a plurality of sizes for which the correction amounts have already been calculated, the correction value obtained by adding the offset value that can be calculated from FIG. 19, to the correction amount of the closest size in the main scanning direction, is the final correction amount. For example, when the recording is performed in the B4 size with the correction amounts of the A4 and the letter sizes already calculated, since the letter size is closer to the B4 size, the B4 correction amount is the value obtained by adding, in a unit of 1/9600 inch, an offset amount of −2 for the region B, and an offset amount of −10 for the region C, to the letter correction amount. Such control is effected solely in sheet sizes in which no test pattern recording has been performed. And, when test pattern recording is performed in the same size, this control is completed, and the correction amount obtained from the test pattern is used as it is.

More specifically, in the present exemplary embodiment, the conveyance correction amount can be stored for each sheet size when conveyance is performed solely by the downstream side conveyance unit; with respect to a sheet size for which the correction amount has already been calculated, the conveyance amount is corrected using that correction amount. On the other hand, with respect to a sheet size for which the correction amount has not been calculated yet, the conveyance amount is corrected using a value obtained by adding a correction amount determined according to the difference in the length in the main scanning direction to the correction amount of the sheet size which is the closest in the length in the main scanning direction, of all the sheet sizes for which the correction amounts have already been calculated. Alternatively, in the present exemplary embodiment, when conveyance is performed by solely using the downstream side conveyance unit, the conveyance correction amount can be stored being classified into a plurality of portions according to the length in the main scanning direction; with respect to a classification for which the correction amount has already been calculated, the conveyance amount is corrected using that correction amount. On the other hand, with respect to a classification for which the correction amount has not been calculated yet, the conveyance amount is corrected using a value obtained by adding a correction amount determined according to a difference in the length in the main scanning direction, to the correction amount of the classification whose length in the main scanning direction is the closest of all the classifications for which the correction amounts have already been calculated.

By the above method, it is possible to effect more accurate correction also regarding the sheet conveyance resistance, which differs according to the sheet size, in addition to the influence of the roller offset in the first through fourth exemplary embodiments, making it possible to obtain a stable and satisfactory image by an appropriate conveyance amount. While in the control unit of the present exemplary embodiment described above the offset table as shown in FIG. 19 is provided for each standard sheet size, it is also possible to adopt a control unit provided with an offset table divided for each sheet size in the main scanning direction as shown in FIG. 18B.

Other Exemplary Embodiments

In the exemplary embodiments described above, aspects of the present invention are applied to a serial type ink jet recording apparatus equipped with an upstream side conveyance unit including a conveyance roller and a downstream side conveyance unit including a discharge roller. However, the aspects also are applicable to any construction in which it is possible to set an appropriate conveyance amount at the time of the conveyance when the sheet leaves the upstream side conveyance unit and at the time of the conveyance using solely the downstream side conveyance unit. In the exemplary embodiments described above, the sheet trailing edge portion is divided into a region B where recording is performed when a first conveyance state is switched to a second conveyance state and into a region C where recording is performed after the switching, and the conveyance correction amount or the offset amount in each region is controlled. However, the aspects also are applicable to any construction in which deterioration in image attributable to a sheet conveyance error after the switching from the first conveyance state to the second conveyance state is effectively suppressed, regardless of the number of divisions or the position of the correction area, and regardless of the presence/absence of offset amount control. More specifically, the embodiments are not restricted to the construction in which the trailing edge portion is divided into a plurality of regions to control a correction amount or an offset amount corresponding to each region. In other words, the embodiments are also applicable to a construction in which the same correction amount or offset amount is applied to the sheet trailing edge portion so long as it helps attain the intended object of effectively suppressing deterioration of an image attributable to a conveyance error. Further, the embodiments are also applicable to a construction in which the correction amount or offset amount is applied to one of the region B and the region C. Further, the types of sheets and the various values used in the description of the above exemplary embodiments are only given by way of example, and it goes without saying that the embodiments are not restricted to them.

In the above exemplary embodiments, aspects of the present invention are applied to a serial type ink jet recording apparatus in which recording is performed by alternately repeating main scanning with a recording head and sub scanning with a conveyance operation. However, the embodiments also are applicable to recording apparatuses of any other recording types, for example, a line type recording apparatus in which recording is performed solely through sub scanning by a conveyance operation. Further, the embodiments are applicable regardless of the kind, nature, and number of inks used. Further, the embodiments are also applicable to a case in which as the material of the recording medium (sheet), various different materials are used, such as paper, plastic film, printing paper, and non-woven fabric.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-039424 filed Feb. 24, 2010, which is hereby incorporated by reference herein in its entirety.

What is claimed is:

1. An ink jet recording apparatus comprising:

a recording head configured to record an image on a recording medium;

a first roller arranged upstream of the recording head in a conveying direction and configured to convey the recording medium;

a second roller arranged downstream of the recording head in the conveying direction and configured to convey the recording medium;

an obtaining unit configured to obtain, in a state in which a sheet is not conveyed by the first roller and is conveyed by the second roller, a conveyance correction amount of the second roller by causing the recording head to record a test pattern on the sheet;

a storing unit configured to store, in a case where the recording head is caused by the obtaining unit to record the test pattern on the sheet, a test-pattern rotating position of the second roller of when a trailing edge of the sheet passes the first roller; and an adjusting unit configured to adjust, in a case where recording of an image on a recording medium is performed by the recording head, a rotating position at which the first roller starts conveyance of the recording medium so that a rotating position of the second roller of when a trailing edge of the recording medium passes the first roller matches the test pattern rotating position.

2. The ink jet recording apparatus according to claim 1, wherein the first roller and the second roller are driven by a same drive source, and wherein a ratio A/B of a diameter A of a drive transmission member of the first roller to a diameter B of a drive transmission member of the second roller is an integer.

3. The ink jet recording apparatus according to claim 1, wherein a nipping portion of a roller pair of the second roller can be switched between a pinching state and a released state, and wherein, at a point in time when the sheet trailing edge reaches a position on an upstream of the first roller at a predetermined distance, the nipping portion is switched from the released state to the pinching state.

4. The ink jet recording apparatus according to claim 1, wherein, when conveyance is performed solely by the second roller, the conveyance correction amount can be stored for each sheet size, and wherein, with respect to a sheet size for which a first correction amount has already been calculated, the first correction amount is used, and, with respect to a sheet size for which no correction amount has been calculated yet, a second correction amount is used, wherein the second correction amount is for a sheet size whose length in a main scanning direction is closest of all sheet sizes for which correction amounts have already been calculated.

5. The ink jet recording apparatus according to claim 4, wherein, with respect to a sheet size for which no correction amount has been calculated yet, a third correction amount determined according to a difference in length in the main scanning direction is added to the second correction amount.

6. The ink jet recording apparatus according to claim 1, wherein, when conveyance is performed solely by the second roller, the conveyance correction amount can be stored while divided into a plurality of classifications according to a length of a sheet size in a main scanning direction, and wherein, with respect to a classification for which a first correction amount has already been calculated, the first correction amount is used, and, with respect to a classification for which no correction amount has been calculated yet, the correction amount of the classification is used, wherein the correction amount of the classification is for a sheet size whose length in the main scanning direction is closest of all divisions for which correction amounts have already been calculated.

7. The ink jet recording apparatus according to claim 6, wherein, with respect to a classification for which no correction amount has been calculated yet, a correction amount determined according to a difference in the length in the main scanning direction is added to the correction amount of the classification.

8. A recording apparatus which performs recording through scanning with a carriage mounted with a recording head that discharges ink along a surface of a sheet, the recording apparatus comprising:

a first conveyance unit arranged upstream of the recording head in a conveying direction and configured to convey the sheet;

a second conveyance unit arranged downstream of the recording head in the conveying direction and configured to convey the sheet; and a control unit effecting control such that a rotation phase of a drive roller in the second conveyance unit when a trailing edge of a sheet of a first size passes the first conveyance unit is the same as a rotation phase of the drive roller when a trailing edge of a sheet of a second size, that is different from the first size, passes the first conveyance unit.

* * * * *